US009714581B2

(12) United States Patent
Okaichi et al.

(10) Patent No.: US 9,714,581 B2
(45) Date of Patent: Jul. 25, 2017

(54) RANKINE CYCLE APPARATUS

(71) Applicant: Panasonic Intellectual Property Management Co., Ltd., Osaka-shi, Osaka (JP)

(72) Inventors: Atsuo Okaichi, Osaka (JP); Osao Kido, Kyoto (JP); Takumi Hikichi, Osaka (JP); Osamu Kosuda, Osaka (JP); Masaya Honma, Saitama (JP); Masanobu Wada, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 270 days.

(21) Appl. No.: 14/395,694

(22) PCT Filed: Jan. 8, 2014

(86) PCT No.: PCT/JP2014/000027
§ 371 (c)(1),
(2) Date: Oct. 20, 2014

(87) PCT Pub. No.: WO2014/112326
PCT Pub. Date: Jul. 24, 2014

(65) Prior Publication Data

US 2015/0107252 A1 Apr. 23, 2015

(30) Foreign Application Priority Data

Jan. 16, 2013 (JP) ..... 2013-005217

(51) Int. Cl.
*F01K 13/02* (2006.01)
*F01D 17/20* (2006.01)
*F01D 17/24* (2006.01)

(52) U.S. Cl.
CPC ..... *F01D 17/20* (2013.01); *F01D 17/24* (2013.01); *F01K 13/02* (2013.01)

(58) Field of Classification Search
CPC ..... F01D 17/20; F01D 17/24; F01K 13/02; F01K 17/02; F01K 25/08; F01K 25/103;
(Continued)

(56) References Cited

U.S. PATENT DOCUMENTS 4,425,762 A * 1/1984 Wakamatsu ..... F01K 9/04 60/646
4,445,180 A * 4/1984 Davis ..... F01D 17/24 290/40 R
(Continued)

FOREIGN PATENT DOCUMENTS

JP 61-145305 7/1986
JP 63-248904 10/1988
(Continued)

OTHER PUBLICATIONS

Extended European Search Report issued in corresponding European Patent Application No. 14741066.6, Feb. 23, 2016, 8 pages.

*Primary Examiner* — Jesse Bogue
(74) *Attorney, Agent, or Firm* — Hamre, Schumann, Mueller & Larson, P.C.

(57) ABSTRACT

A Rankine cycle apparatus (1A) of the present disclosure includes a main circuit (10), a heat exchange portion (HX), a bypass flow path (20), a flow rate-adjusting mechanism (3), and a pair of temperature sensors (7A). The main circuit (10) is formed by an expander (11), a condenser (13), a pump (14), and an evaporator (15) that are circularly connected in this order. The heat exchange portion (HX) is located in the main circuit (10) at a position between an outlet of the expander (11) and an inlet of the pump (14). The bypass flow path (20) branches from the main circuit (10) at a position between an outlet of the evaporator (15) and an
(Continued)

inlet of the expander (11), and joins to the main circuit (10) at a position between the outlet of the expander (11) and an inlet of the heat exchange portion (HX). The flow rate-adjusting mechanism (3) adjusts the flow rate of the working fluid in the bypass flow path (20). The pair of temperature sensors (7A) detects temperatures of the working fluid at two positions spaced from each other in a flow direction of the working fluid.

14 Claims, 12 Drawing Sheets

(58) Field of Classification Search
CPC ..... F01K 23/04; F01K 25/10; F01K 25/106; F01K 7/24; F01K 9/04; Y02E 20/14; F02G 5/02; F22B 1/18
See application file for complete search history.

(56) References Cited

U.S. PATENT DOCUMENTS 5,421,157 A * 6/1995 Rosenblatt ..... F01K 25/08 60/649
6,457,313 B1 10/2002 Fujii
7,950,230 B2 5/2011 Nishikawa et al.
2003/0213245 A1 11/2003 Yates
2003/0213246 A1* 11/2003 Coll ..... F01K 17/02 60/653
2003/0213247 A1* 11/2003 Hanna ..... F01K 17/02 60/670
2009/0241543 A1 10/2009 Ernst
2012/0131919 A1 5/2012 Held
2012/0216762 A1* 8/2012 Ernst ..... F01N 5/02 123/41.21
2012/0255304 A1 10/2012 Li et al.
2014/0373542 A1* 12/2014 Yanagi ..... F01K 23/10 60/651

FOREIGN PATENT DOCUMENTS

JP 2002-341947 11/2002
JP 2009-097387 5/2009
JP 2009-283178 12/2009
JP 2012-117410 6/2012
WO 2011/111082 9/2011
WO 2012/021881 2/2012

* cited by examiner

RANKINE CYCLE APPARATUS

TECHNICAL FIELD

The present invention relates to Rankine cycle apparatuses.

BACKGROUND ART

Conventionally, Rankine cycle apparatuses are known as apparatuses for generating electricity. As one example of the configurations of the Rankine cycle apparatuses, a configuration having a bypass flow path for allowing a working fluid to bypass a turbine is known.

Patent Literature 1 discloses a Rankine cycle apparatus 100 which, as shown in FIG. 16, is formed by a steam stop valve 103A, a turbine 111, a condenser 113, a pump 114, and an evaporator 115 that are circularly connected. The Rankine cycle apparatus 100 has a turbine bypass flow path 120 including a bypass valve 103B. The opening and closing of the bypass valve 103B are controlled by an output signal from a pressure-setting regulator 105 to which is input a pressure signal from a pressure detector 107 that detects a pressure on the upstream side of the steam stop valve 103A. The pressure-setting regulator 105 performs control so that the bypass valve 103B is opened when the pressure on the upstream side of the steam stop valve 103A becomes equal to or higher than a predetermined value. In this manner, the Rankine cycle apparatus 100 fulfills the bypass operation function during the start-up period and the pressure control function.

CITATION LIST

Patent Literature

Patent Literature 1: JP 61-145305 A

SUMMARY OF INVENTION

Technical Problem

The Rankine cycle apparatus 100 of Patent Literature 1 needs to detect the pressure of the working fluid in order to adjust the flow rate of the working fluid in the bypass flow path bypassing the expander such as a turbine.

The present invention aims to provide a Rankine cycle apparatus having a relatively simple configuration capable of adjusting the flow rate of a working fluid in a bypass flow path bypassing an expander.

Solution to Problem

The present disclosure provides a Rankine cycle apparatus including:

a main circuit formed by an expander, a condenser, a pump, and an evaporator that are circularly connected in this order;

a heat exchange portion located in the main circuit at a position between an outlet of the expander and an inlet of the pump;

a bypass flow path branching from the main circuit at a position between an outlet of the evaporator and an inlet of the expander and joining to the main circuit at a position between the outlet of the expander and an inlet of the heat exchange portion;

a flow rate-adjusting mechanism that adjusts a flow rate of a working fluid in the bypass flow path; and a pair of temperature sensors that detects temperatures of the working fluid at two positions spaced from each other in a flow direction of the working fluid in a portion of the main circuit between a junction point at which the bypass flow path joins to the main circuit and an inlet of the evaporator.

The two positions are determined so that when the working fluid flowing into the heat exchange portion is a superheated vapor, a difference between the temperature of the working fluid at one of the two positions and the temperature of the working fluid at the other of the two positions is equal to or larger than a predetermined value.

Advantageous Effects of Invention

With the above Rankine cycle apparatus, the flow rate of the working fluid in the bypass flow path can be adjusted based on the result of detection by the pair of temperature sensors.

DESCRIPTION OF EMBODIMENTS

Figure 1:
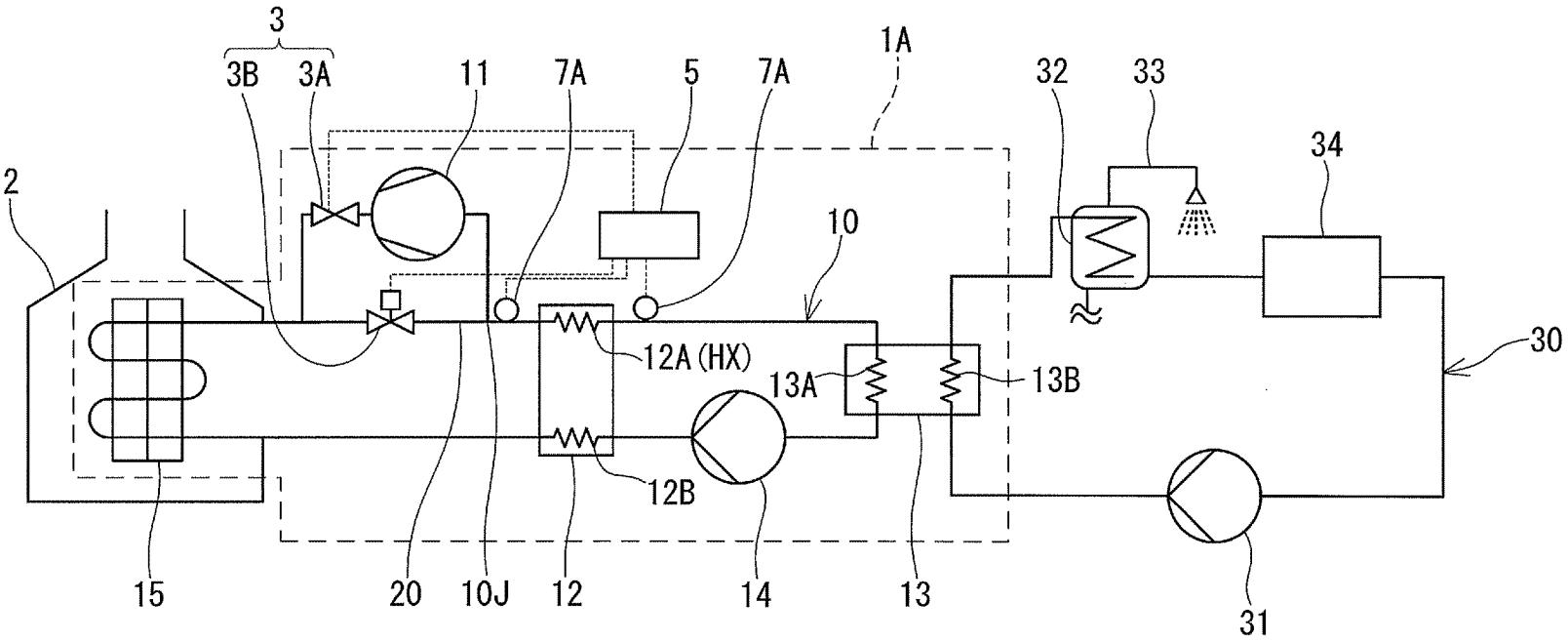
FIG. 1 is a configuration diagram of a Rankine cycle apparatus according to a first embodiment.

In the start-up operation of a Rankine cycle apparatus, a working fluid in a liquid state is delivered to an evaporator by actuation of a pump before the start of heating by the evaporator. After the start of heating of the working fluid in the evaporator, when the heating of the working fluid by the evaporator continues, the dryness of the working fluid at the outlet of the evaporator gradually increases. In this case, the operation of the Rankine cycle apparatus is performed so that the working fluid at the outlet of the evaporator is in the form of a superheated vapor with appropriate degree of superheat.

At the early stage of the start-up operation of the Rankine cycle apparatus, the working fluid at the outlet of the evaporator is a wet vapor; therefore, the working fluid in a liquid state flows out of the outlet of the evaporator. Consequently, the working fluid in a liquid state is supplied to the expander such as a turbine. When the expander is a fluid-flow machinery such as a turbine, there is a possibility that collision of the working fluid in a liquid state with the turbine blade causes thinning phenomenon. This disadvantageously reduces the reliability of the Rankine cycle apparatus. When the expander is a positive-displacement machinery such as a scroll expander, the working fluid in a liquid state could wash away an oil for lubrication and create a situation where no oil film is formed on the parts of the expander. This may lead to insufficient lubrication between the parts of the expander, resulting in reduction of the reliability of the Rankine cycle apparatus.

Such problems could arise also when the working fluid at the outlet of the evaporator is brought into a liquid state or a gas-liquid two-phase state due to the state change of the cycle which is caused, for example, by variation in the amount of heating in the evaporator. In addition, in the stop operation of the Rankine cycle apparatus, the working fluid in a liquid state needs to be supplied to the evaporator by a pump after the stop of the heating in the evaporator for the purpose of cooling the evaporator. Also in this case, the above-described problems could arise because there is a possibility that the working fluid in a liquid state is supplied to the expander.

Therefore, when the working fluid in a liquid state could flow into the expander, it is necessary to stop the operation of the expander and allow the working fluid to bypass the expander. The Rankine cycle apparatus 100 of Patent Literature 1 is disclosed as a Rankine cycle apparatus in which the working fluid can bypass the expander. The Rankine cycle apparatus 100 controls the opening and closing of the bypass valve 103B by detecting the pressure of the working fluid at the inlet of the turbine 111. However, the production cost of the Rankine cycle apparatus is high since pressure sensors used in Rankine cycle apparatuses are generally expensive.

A first aspect of the present disclosure provides a Rankine cycle apparatus including:

a main circuit formed by an expander, a condenser, a pump, and an evaporator that are circularly connected in this order;

a heat exchange portion located in the main circuit at a position between an outlet of the expander and an inlet of the pump;

a bypass flow path branching from the main circuit at a position between an outlet of the evaporator and an inlet of the expander and joining to the main circuit at a position between the outlet of the expander and an inlet of the heat exchange portion;

a flow rate-adjusting mechanism that adjusts a flow rate of a working fluid in the bypass flow path; and a pair of temperature sensors that detects temperatures of the working fluid at two positions spaced from each other in a flow direction of the working fluid in a portion of the main circuit between a junction point at which the bypass flow path joins to the main circuit and an inlet of the evaporator, wherein the two positions are determined so that when the working fluid flowing into the heat exchange portion is a superheated vapor, a difference between the temperature of the working fluid at one of the two positions and the temperature of the working fluid at the other of the two positions is equal to or larger than a predetermined value.

According to the first aspect, the state of the working fluid at the outlet of the expander or the outlet of the bypass flow path can be found by detecting two temperatures of the working fluid by the pair of temperature sensors. Therefore, it is possible to achieve the operation of the Rankine cycle apparatus appropriate for the state of the working fluid at the outlet of the expander or the outlet of the bypass flow path. As a result, the reliability of the Rankine cycle apparatus can be improved.

A second aspect of the present disclosure provides the Rankine cycle apparatus as set forth in the first aspect, further including a controller that controls the flow rate-adjusting mechanism, wherein the controller controls the flow rate-adjusting mechanism so that the flow rate of the working fluid in the bypass flow path is reduced when a difference between two temperatures detected by the pair of temperature sensors exceeds a first threshold. According to the second aspect, in the case where the difference between the two temperatures detected by the pair of temperature sensors exceeds the first threshold, the working fluid flowing into the heat exchange portion is a superheated vapor. In this case, the flow rate-adjusting mechanism is controlled so that the flow rate of the working fluid in the bypass flow path is reduced. In this manner, the flow rate of the working fluid in the bypass flow path is adjusted based on the difference between the two temperatures detected by the pair of temperature sensors. When the working fluid at the outlet of the expander or the outlet of the bypass flow path is a superheated vapor, the flow rate-adjusting mechanism is controlled so that the flow rate of the working fluid in the bypass flow path is reduced; therefore, the reliability of the Rankine cycle apparatus can be improved.

A third aspect of the present disclosure provides the Rankine cycle apparatus as set forth in the first aspect, further including a controller that controls the flow rate-adjusting mechanism, wherein the controller controls the flow rate-adjusting mechanism so that the flow rate of the working fluid in the bypass flow path is increased when a difference between two temperatures detected by the pair of temperature sensors becomes equal to or smaller than a second threshold. According to the third aspect, in the case where the difference between the two temperatures detected by the pair of temperature sensors becomes equal to or smaller than the second threshold, there is a possibility that the working fluid is a wet vapor at the outlet of the expander or the outlet of the bypass flow path. In this case, the flow rate-adjusting mechanism is controlled so that the flow rate of the working fluid in the bypass flow path is increased. According to the third aspect, when there is a possibility that the working fluid in a liquid state is supplied to the expander, the flow rate-adjusting mechanism is controlled so that the flow rate of the working fluid in the bypass flow path is increased; therefore, the supply of the working fluid in a liquid state to the expander can be restrained. As a result, the reliability of the Rankine cycle apparatus can be improved.

A fourth aspect of the present disclosure provides the Rankine cycle apparatus as set forth in any one of the first to third aspects, wherein the heat exchange portion is configured as a flow path of the working fluid in the condenser, and the pair of temperature sensors detects: a temperature of the working fluid in a portion of the main circuit between the junction point and an inlet of the condenser; and a temperature of the working fluid in the condenser or a temperature of the working fluid in a portion of the main circuit between an outlet of the condenser and the inlet of the evaporator. According to the fourth aspect, the heat exchange portion can be configured as a flow path of the working fluid in the condenser. The condenser is an essential component for a Rankine cycle apparatus. Therefore, the flow rate of the working fluid in the bypass flow path can be controlled with a simple configuration depending on the state of the working fluid at the outlet of the expander or the outlet of the bypass flow path.

A fifth aspect of the present disclosure provides the Rankine cycle apparatus as set forth in the fourth aspect, wherein the pair of temperature sensors detects the temperature of the working fluid in the portion of the main circuit between the junction point and the inlet of the condenser and a temperature of the working fluid in a portion of the main circuit between the outlet of the condenser and the inlet of the pump. According to the fifth aspect, the refrigerant at the inlet of the pump is in a state of supercooled liquid; therefore, when one of the temperature sensor detects the temperature of the working fluid that is in a state of superheated gas, the difference between the two temperatures detected by the pair of temperature sensors is large, and the state of the working fluid at the outlet of the expander or the outlet of the bypass flow path can easily be determined.

A sixth aspect of the present disclosure provides the Rankine cycle apparatus as set forth in the fourth aspect, wherein the pair of temperature sensors detects the temperature of the working fluid in the portion of the main circuit between the junction point and the inlet of the condenser and a temperature of the working fluid in a portion of the main circuit between an outlet of the pump and the inlet of the evaporator. According to the sixth aspect, the temperature sensor is placed on the side of the outlet of the pump; therefore, the length of the piping from the condenser to the pump can be shortened. Accordingly, heat input from the external environment to the working fluid on the side of the inlet of the pump can be prevented, and cavitation due to pressure loss of the working fluid can be reduced.

A seventh aspect of the present disclosure provides the Rankine cycle apparatus as set forth in the fourth aspect, wherein the pair of temperature sensors detects the temperature of the working fluid in the portion of the main circuit between the junction point and the inlet of the condenser and the temperature of the working fluid in the condenser. According to the seventh aspect, the temperature of the working fluid that is being condensed in the condenser can be detected; that is, the condensation temperature can be detected. Therefore, when the value of the temperature of the working fluid in the portion of the main circuit between the junction point and the inlet of the condenser is higher than the condensation temperature, the working fluid in the portion of the main circuit between the junction point and the inlet of the condenser is in a state of superheated gas. Thus, the difference between the two temperatures can be detected by the pair of temperature sensors accurately.

An eighth aspect of the present disclosure provides the Rankine cycle apparatus as set forth in any one of the first to third aspects, further including:

a first heat exchange portion serving as the heat exchange portion and located in the main circuit at a position between the junction point and an inlet of the condenser; and a second heat exchange portion located in the main circuit at a position between an outlet of the pump and the inlet of the evaporator and adapted for heat exchange with the first heat exchange portion, wherein the pair of temperature sensor detects a combination of two temperatures selected from: a temperature of the working fluid in a portion of the main circuit between the junction point and an inlet of the first heat exchange portion; a temperature of the working fluid in the first heat exchange portion; a temperature of the working fluid in a portion of the main circuit between an outlet of the first heat exchange portion and the inlet of the condenser; a temperature of the working fluid in a portion of the main circuit between an outlet of the condenser and an inlet of the second heat exchange portion; a temperature of the working fluid in the second heat exchange portion; and a temperature of the working fluid in a portion of the main circuit between an outlet of the second heat exchange portion and the inlet of the evaporator, with the exception of a combination of two temperatures selected from the temperature of the working fluid in the first heat exchange portion, the temperature in the portion of the main circuit between the outlet of the first heat exchange portion and the inlet of the condenser, and the temperature of the working fluid in the portion of the main circuit between the outlet of the condenser and the inlet of the second heat exchange portion; and a combination of the temperature of the working fluid in the second heat exchange portion and the temperature of the working fluid in the portion of the main circuit between the outlet of the second heat exchange portion and the inlet of the evaporator.

According to the eighth aspect, the state of the working fluid at the outlet of the expander or the outlet of the bypass flow path can be determined by detecting two temperatures by the pair of temperature sensors. Therefore, it is possible to achieve the operation of the Rankine cycle apparatus appropriate for the state of the working fluid at the outlet of the expander or the outlet of the bypass flow path. As a result, the reliability of the Rankine cycle apparatus can be improved.

A ninth aspect of the present disclosure provides the Rankine cycle apparatus as set forth in the eighth aspect, wherein the pair of temperature sensors detects: the temperature of the working fluid in the portion of the main circuit between the junction point and the inlet of the first heat exchange portion; and the temperature of the working fluid in the portion of the main circuit between the outlet of the first heat exchange portion and the inlet of the condenser or the temperature of the working fluid in the first heat exchange portion. According to the ninth aspect, when the working fluid is a wet vapor at the outlet of the expander or the outlet of the bypass flow path, the temperature of the working fluid in the portion of the main circuit between the junction point and the inlet of the first heat exchange portion is approximately equal to the temperature of the working fluid in the portion of the main circuit between the outlet of the first heat exchange portion and the inlet of the condenser or to the temperature of the working fluid in the first heat exchange portion. Therefore, the state of the working fluid at the outlet of the expander or the outlet of the bypass flow path can be determined with high accuracy. Based on the determination, the flow rate of the working fluid in the bypass flow path can be adjusted.

A tenth aspect of the present disclosure provides the Rankine cycle apparatus as set forth in the eighth aspect, wherein the pair of temperature sensors detects: the temperature of the working fluid in the portion of the main circuit between the outlet of the condenser and the inlet of the second heat exchange portion; and the temperature of the working fluid in the portion of the main circuit between the outlet of the second heat exchange portion and the inlet of the evaporator or the temperature of the working fluid in the second heat exchange portion. According to the tenth aspect, the temperature of the working fluid hardly changes in the portion between the outlet of the condenser and the inlet of the second heat exchange portion. Therefore, the temperature change of the working fluid caused by the flow of the working fluid from the inlet of the second heat exchange portion to the outlet of the second heat exchange portion can be evaluated by detecting the difference between the above two temperatures. Thus, it can be determined whether heat exchange takes place between the first heat exchange portion and the second heat exchange portion. As a result, the state of the working fluid at the outlet of the expander or the outlet of the bypass flow path can be determined. Based on the determination, the flow rate of the working fluid in the bypass flow path can be adjusted. The temperature of the working fluid in the portion of the main circuit between the outlet of the condenser and the inlet of the second heat exchange portion is relatively low, and the temperature of the working fluid in the portion of the main circuit between the outlet of the second heat exchange portion and the inlet of the evaporator or the temperature of the working fluid in the second heat exchange portion is relatively low. That is, the pair of temperature sensors are disposed at positions where the temperature is relatively low; therefore, the long-term reliability of the pair of temperature sensors can be ensured.

An eleventh aspect of the present disclosure provides the Rankine cycle apparatus as set forth in the tenth aspect, wherein one of the pair of temperature sensors detects a temperature of the working fluid in a portion of the main circuit between the outlet of the pump and the inlet of the second heat exchange portion. According to the eleventh aspect, the first threshold or the second threshold for the difference between the two temperatures detected by the pair of temperature sensors can be set without considering the influence exerted by the pump on the temperature of the working fluid.

A twelfth aspect of the present disclosure provides the Rankine cycle apparatus as set forth in any one of the first to eleventh aspects, wherein the working fluid is a fluid for which a value of ds/dT in a saturation vapor line on a T-s diagram is a negative value or is substantially zero. According to the twelfth aspect, when the working fluid discharged from the expander is a superheated vapor, the working fluid supplied to the expander is a superheated vapor. Therefore, it is possible to prevent the reliability of the expander from being reduced by the working fluid in a liquid state.

A thirteenth aspect of the present disclosure provides the Rankine cycle apparatus as set forth in any one of the first to twelfth aspects, wherein the flow rate-adjusting mechanism includes a three-way valve provided at a point of connection of the main circuit to an upstream end of the bypass flow path. According to the thirteenth aspect, the flow rate in the bypass flow path can be adjusted with a relatively simple configuration.

A fourteenth aspect of the present disclosure provides the Rankine cycle apparatus as set forth in any one of the first to thirteenth aspects, wherein the flow rate-adjusting mechanism includes: a first on-off valve provided in the main circuit at a position between a point of connection of the main circuit to an upstream end of the bypass flow path and the inlet of the expander; and an expansion valve provided in the bypass flow path. According to the fourteenth aspect, supply of the working fluid in a liquid state to the expander can be prevented by the first on-off valve. In addition, the working fluid in the form of a superheated vapor which is not supplied to the expander can be decompressed by the expansion valve provided in the bypass flow path.

A fifteenth aspect of the present disclosure provides the Rankine cycle apparatus as set forth in the fourteenth aspect, wherein the flow rate-adjusting mechanism further includes a second on-off valve provided in the bypass flow path. According to the fifteenth aspect, the flow rate in the bypass flow path can be adjusted by the second on-off valve so that the working fluid does not flow in the bypass flow path.

A sixteenth aspect of the present disclosure provides the Rankine cycle apparatus as set forth in any one of the first to fifteenth aspects, wherein the first threshold or the second threshold is set so that either the working fluid at the inlet of the expander or the working fluid at the outlet of the expander, which has a smaller degree of superheat than the other, has a degree of superheat of 5° C. or more. According to the sixteenth aspect, the working fluid is less likely to change to a wet vapor even when adiabatically expanded by the expander.

Hereinafter, embodiments of the present disclosure will be described with reference to the drawings. The following description relates to examples of the present invention, and the present invention is not limited by these examples.

First Embodiment

As shown in FIG. 1, a Rankine cycle apparatus 1A includes a main circuit 10, a bypass flow path 20, a flow rate-adjusting mechanism 3, a pair of temperature sensors 7A, and a controller 5. The main circuit 10 has an expander 11, a condenser 13, a pump 14, and an evaporator 15, and is formed by these components being circularly connected in the mentioned order. The Rankine cycle apparatus 1A includes a heat exchange portion HX located in the main circuit 10 at a position between the outlet of the expander 11 and the inlet of the pump 14. The bypass flow path 20 branches from the main circuit 10 at a position between the outlet of the evaporator 15 and the inlet of the expander 11, and joins to the main circuit 10 at a position between the outlet of the expander 11 and the heat exchange portion HX. The Rankine cycle apparatus 1A includes a first heat exchange portion 12A serving as the heat exchange portion HX and a second heat exchange portion 12B adapted for heat exchange with the first heat exchange portion 12A. The first heat exchange portion 12A is located in the main circuit 10 at a position between a junction point 10J at which the bypass flow path 20 joins to the main circuit 10 and the inlet of the condenser 13. The second heat exchange portion 12B is located in the main circuit 10 at a position between the outlet of the pump 14 and the inlet of the evaporator 15. A reheater 12 is constituted by the first heat exchange portion 12A and the second heat exchange portion 12B. The first heat exchange portion 12A forms a flow path on the low-pressure side of the reheater 12. The second heat exchange portion 12B forms a flow path on the high-pressure side of the reheater 12. The working fluid in the first heat exchange portion 12A exchanges heat with the working fluid in the second heat exchange portion 12B. The evaporator 15 heats the working fluid flowing in the evaporator 15 by combustion heat generated by a boiler 2. Another heat source that generates exhaust heat, geothermal heat, solar heat or the like may be used instead of the boiler 2 as a heat source for heating the working fluid. The condenser 13 constitutes a part of the main circuit 10 and also constitutes a part of a hot-water circuit 30. The condenser 13 has a condensing portion 13A on the main circuit 10 side and a cooling portion 13B on the hot-water circuit 30 side. The working fluid flowing in the condensing portion 13A is cooled and condensed by cooling water flowing in the cooling portion 13B. The hot-water circuit 30 has a hot water pump 31, a cooling portion 13B, a hot-water supply tank 32, and a radiator 34, and is formed by these components being circularly connected.

The flow rate-adjusting mechanism 3 adjusts the flow rate of the working fluid in the bypass flow path 20. In the present embodiment, the flow rate-adjusting mechanism 3 includes: a first on-off valve 3A provided between a point of connection of the main circuit 10 to the upstream end of the bypass flow path 20 and the expander 11; and an expansion valve 3B provided in the bypass flow path 20. The first on-off valve 3A is, for example, a solenoid on-off valve. The expansion valve 3B is, for example, an electric operated expansion valve.

The pair of temperature sensors 7A detects temperatures of the working fluid at two positions spaced from each other in the flow direction of the working fluid in a portion of the main circuit 10 between the junction point 10J at which the bypass flow path 20 joins to the main circuit 10 and the inlet of the evaporator 15. The two positions are determined so that when the working fluid flowing into the heat exchange portion HX is a superheated vapor, a difference between the temperature of the working fluid at one of the two positions and the temperature of the working fluid at the other of the two positions is equal to or larger than a predetermined value. This predetermined value is, for example, 5° C.

For example, the pair of temperature sensors 7A detects a combination of two temperatures selected from: a temperature of the working fluid in a portion of the main circuit 10 between the junction point 10J and the inlet of the first heat exchange portion 12A; a temperature of the working fluid in the first heat exchange portion 12A; a temperature of the working fluid in a portion of the main circuit 10 between the outlet of the first heat exchange portion 12A and the inlet of the condenser 13; a temperature of the working fluid in a portion of the main circuit 10 between the outlet of the condenser 13 and the inlet of the second heat exchange portion 12B; a temperature of the working fluid in the second heat exchange portion 12B; and the temperature of the working fluid in a portion of the main circuit 10 between the outlet of the second heat exchange portion 12B and the inlet of the evaporator 15, with the exception of a combination of two temperatures selected from the temperature of the working fluid in the first heat exchange portion 12A, the temperature of the working fluid in the portion of the main circuit 10 between the outlet of the first heat exchange portion 12A and the inlet of the condenser 13, and the temperature of the working fluid in the portion of the main circuit 10 between the outlet of the condenser 13 and the inlet of the second heat exchange portion 12B; and a combination of the temperature of the working fluid in the second heat exchange portion 12B and the temperature of the working fluid in the portion of the main circuit 10 between the outlet of the second heat exchange portion 12B and the inlet of the evaporator 15. In the present embodiment, the pair of temperature sensors 7A detects the temperature of the working fluid in the portion of the main circuit 10 between the junction point 10J and the inlet of the first heat exchange portion 12A and the temperature of the working fluid in the portion of the main circuit 10 between the outlet of the first heat exchange portion 12A and the inlet of the condenser 13. Specifically, the temperature of the working fluid in the portion of the main circuit 10 between the outlet of the first heat exchange portion 12A and the inlet of the condenser 13 is detected. One of the temperature sensors 7A detects the temperature of the working fluid at the outlet of the first heat exchange portion 12A. As mentioned herein, the temperature of the working fluid in the first heat exchange portion 12A means, for example, a temperature of the working fluid at a position that is located in a flow path of the working fluid in the first heat exchange portion 12A and that is closer to the outlet of the first heat exchange portion 12A than a position located at an equal distance from the inlet and outlet of the first heat exchange portion 12A. The temperature of the working fluid in the second heat exchange portion 12B means, for example, a temperature of the working fluid at a position that is located in a flow path of the working fluid in the second heat exchange portion 12B and that is closer to the outlet of the second heat exchange portion 12B than a position located at an equal distance from the inlet and outlet of the second heat exchange portion 12B.

The controller 5 receives signals representing the detection results from the pair of temperature sensors 7A, generates a control signal based on the detection results from the pair of temperature sensors 7A, and transmits the control signal to the flow rate-adjusting mechanism 3, thereby controlling the flow rate-adjusting mechanism 3. Thus, the flow rate-adjusting mechanism 3 adjusts the flow rate of the working fluid in the bypass flow path 20. When the difference between the two temperatures detected by the pair of temperature sensors 7A exceeds a first threshold (temperature-increase threshold), the controller 5 controls the flow rate-adjusting mechanism 3 so that the flow rate of the working fluid in the bypass flow path 20 is reduced. On the other hand, when the difference between the two temperatures detected by the pair of temperature sensors 7A becomes equal to or smaller than a second threshold (temperature-decrease threshold), the controller 5 controls the flow rate-adjusting mechanism 3 so that the flow rate of the working fluid in the bypass flow path 20 is increased.

Figure 2:
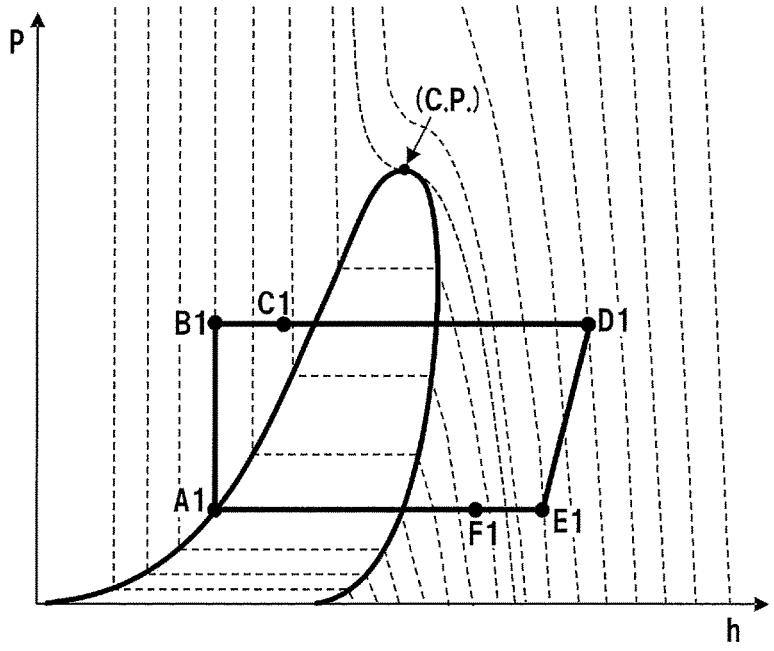
FIG. 2 is a Mollier diagram for the period during which a Rankine cycle apparatus is in normal operation.

The behavior of the Rankine cycle apparatus 1A in the normal operation will be described with reference to FIG. 2. FIG. 2 is a Mollier diagram for the working fluid, and dashed lines represent isothermal lines. In the normal operation, the flow rate-adjusting mechanism 3 is controlled so that the flow rate of the working fluid in the bypass flow path 20 is at a minimum or zero. A dot A1 in FIG. 2 indicates the state of the working fluid in the portion of the main circuit 10 between the outlet of the condenser 13 and the inlet of the pump 14. In this state, the working fluid is a saturated liquid or a supercooled liquid. The working fluid is pressurized by the pump 14. At this time, the temperature of the working fluid hardly changes; therefore, the working fluid in the portion of the main circuit 10 between the outlet of the pump 14 and the inlet of the second heat exchange portion 12B is a supercooled liquid as indicated by a dot B1. The working fluid in the second heat exchange portion 12B is heated by the working fluid in the first heat exchange portion 12A; therefore, the working fluid in the portion of the main circuit 10 between the outlet of the second heat exchange portion 12B and the inlet of the evaporator 15 is, for example, a supercooled liquid as indicated by a dot C1. In some cases, the working fluid is a wet vapor having a pressure equal to that in the state indicated by the dot C1.

In the evaporator 15, the working fluid is heated and changes to a superheated vapor. Therefore, the working fluid at the outlet of the evaporator 15 is a superheated vapor as indicated by a dot D1. The working fluid in the form of this superheated vapor is supplied to the expander 11, and the working fluid is adiabatically expanded by the expander 11. Therefore, the working fluid in the portion of the main circuit 10 between the junction point 10J and the inlet of the first heat exchange portion 12A is a superheated vapor as indicated by a dot E1. The working fluid in the first heat exchange portion 12A is cooled by the working fluid in the second heat exchange portion 12B. Therefore, the working fluid in the portion of the main circuit 10 between the outlet of the first heat exchange portion 12A and the inlet of the condenser 13 is a superheated vapor as indicated by a dot F1. The working fluid in the condenser 13 is cooled and condensed by cooling water in the cooling portion 13B. Therefore, the working fluid in the portion of the main circuit 10 between the outlet of the condenser 13 and the inlet of the pump 14 is a saturated liquid or a supercooled liquid as indicated by the dot A1. In the normal operation of the Rankine cycle apparatus 1A, the working fluid circulates in the main circuit 10 with the state changes as described above.

The expander 11 is a fluid-flow expander such as a turbine or a positive-displacement expander such as a scroll expander. An electricity generator (omitted from the drawings) is driven by the expander 11 to generate electricity. In the hot-water circuit 30, the cooling water heated in the cooling portion 13B of the condenser 13 is supplied to the hot-water supply tank 32 and the radiator 34. Thus, exhaust heat from the working fluid in the condenser 13 can be used for hot-water supply or indoor heating.

Figure 3:
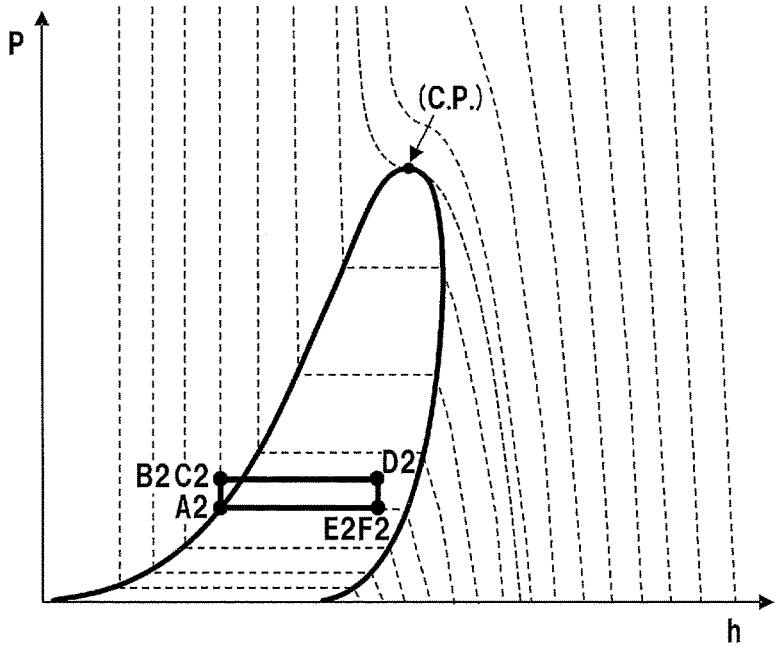
FIG. 3 is a Mollier diagram for the period during which the start-up operation of a Rankine cycle apparatus is at an early stage.

The adjustment of the flow rate of the working fluid in the bypass flow path 20 will be described using the start-up operation and stop operation of the Rankine cycle apparatus 1A as examples. At the early stage of the start-up operation, the liquid supply amount of the pump 14 is set at a maximum. In this case, the Rankine cycle apparatus 1A behaves in a manner as shown in FIG. 3. In FIG. 3, the positions at which the working fluid has states indicated by dots A2, B2, C2, D2, E2, and F2 are respectively the same as the positions at which the working fluid has the states indicated by the dots A1, B1, C1, D1, E1, and F1 of FIG. 2. As shown in FIG. 3, the state of the working fluid at the outlet of the evaporator 15 is the wet vapor state as indicated by the dot D2. Therefore, at the early stage of the start-up operation, the on-off valve 3A is closed, so that the supply of the working fluid in a liquid state to the expander 11 is prevented. In addition, the operation of the expander 11 is at a stop. After flowing out of the evaporator 15, the working fluid flows in the bypass flow path 20 at a maximum flow rate. The working fluid in the bypass flow path 20 is decompressed by the expansion valve 3B; therefore, the working fluid at the outlet of the bypass flow path 20 is a wet vapor as indicated by the dot E2.

When the working fluid at the outlet of the bypass flow path 20 is a wet vapor, the working fluid in the state indicated by E2 shifts to the state indicated by C2 along the isothermal line since the temperature of the working fluid hardly changes in the condenser 13 and in the pump 14. In this case, the temperature of the working fluid at the inlet of the first heat exchange portion 12A (dot E2) and the temperature of the working fluid at the inlet of the second heat exchange portion 12B (dot B2) are approximately equal; therefore, heat exchange does not take place between the first heat exchange portion 12A and the second heat exchange portion 12B. Accordingly, the state of the working fluid hardly changes in the first heat exchange portion 12A and in the second heat exchange portion 12B; thus, as shown in FIG. 3, the dots E2 and F2 coincide with each other and the dots B2 and C2 coincide with each other. In this case, the two temperatures detected by the pair of temperature sensors 7A are approximately equal; therefore, the difference between the two temperatures detected by the pair of temperature sensors 7A could not exceed the first threshold. Therefore, the controller 5 does not perform such control of the flow rate-adjusting mechanism 3 that flow rate of the working fluid in the bypass flow path 20 is reduced.

Figure 4:
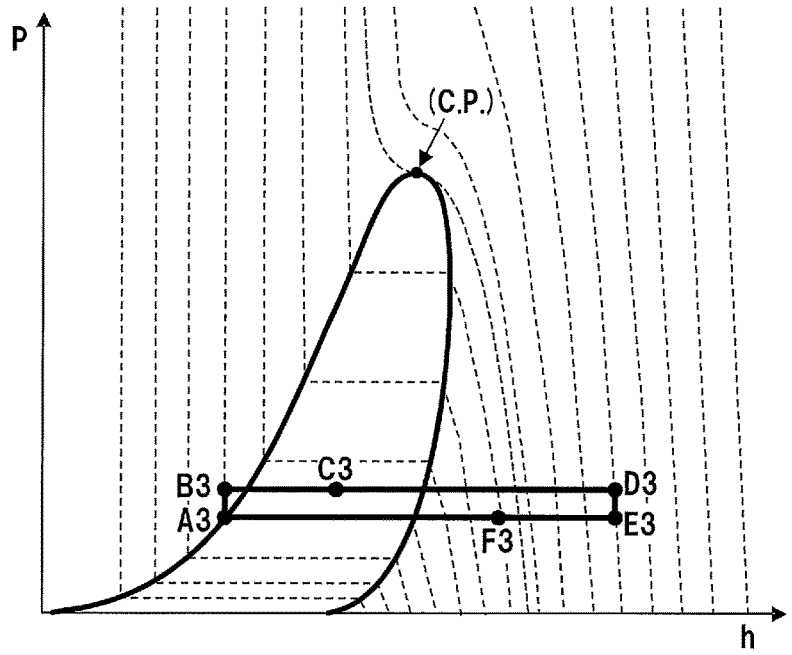
FIG. 4 is a Mollier diagram for the period during which the start-up operation of a Rankine cycle apparatus is at a transient stage.

At the transient stage of the start-up operation, the liquid supply amount of the pump 14 is decreased gradually. In this case, the behavior of the Rankine cycle apparatus 1A gradually changes from the state shown in FIG. 3 to the state shown in FIG. 4. In FIG. 4, the positions at which the working fluid has states indicated by dots A3, B3, C3, D3, E3, and F3 are respectively the same as the positions at which the working fluid has the states indicated by the dots A1, B1, C1, D1, E1, and F1 of FIG. 2.

As shown in FIG. 4, at the transient stage of the start-up operation, the working fluid at the outlet of the evaporator 15 changes to a superheated vapor, increases its degree of superheat, and enters the state indicated by the dot D3. In this case, the working fluid at the inlet of the first heat exchange portion 12A also increases its degree of superheat, and changes to a superheated vapor as indicated by the dot E3. Meanwhile, the working fluid in the portion of the main circuit 10 between the condenser 13 and the pump 14 is, as indicated by the dot A3, a saturated liquid or a supercooled liquid supercooled to a temperature slightly below the saturation temperature. The temperature of the working fluid is hardly changed by the pump 14; therefore, the working fluid in the portion of the main circuit 10 between the pump 14 and the second heat exchange portion 12B is a supercooled liquid as indicated by the dot B3. Accordingly, the temperature of the working fluid at the inlet of the first heat exchange portion 12A is higher than the temperature of the working fluid at the inlet of the second heat exchange portion 12B. Consequently, heat exchange takes place between the first heat exchange portion 12A and the second heat exchange portion 12B.

The working fluid in the first heat exchange portion 12A is cooled by the second heat exchange portion 12B; thus, as indicated by the dot F3, the working fluid becomes a superheated vapor having a lower temperature than the working fluid at the dot E3. Meanwhile, the working fluid in the second heat exchange portion 12B is heated by the second heat exchange portion 12B; thus, as indicated by the dot C3, the working fluid becomes a wet vapor having a higher temperature than the working fluid at the dot B3. Therefore, at the transient stage of the start-up operation, a difference occurs between the two temperatures detected by the pair of temperature sensors 7A, and the temperature difference gradually increases. In the course of this process, when the difference between the two temperatures detected by the pair of temperature sensors 7A exceeds the first threshold, the controller 5 controls the flow rate-adjusting mechanism 3 so that the flow rate of the working fluid in the bypass flow path 20 is reduced. Specifically, the first on-off valve 3A is opened to supply the working fluid to the expander 11. In this case, the working fluid at the outlet of the evaporator 15 is a superheated vapor; therefore, the working fluid in a liquid state is not supplied to the expander 11. This prevents a situation where the reliability of the expander 11 is reduced by supply of the working fluid in a liquid state.

Figure 5:
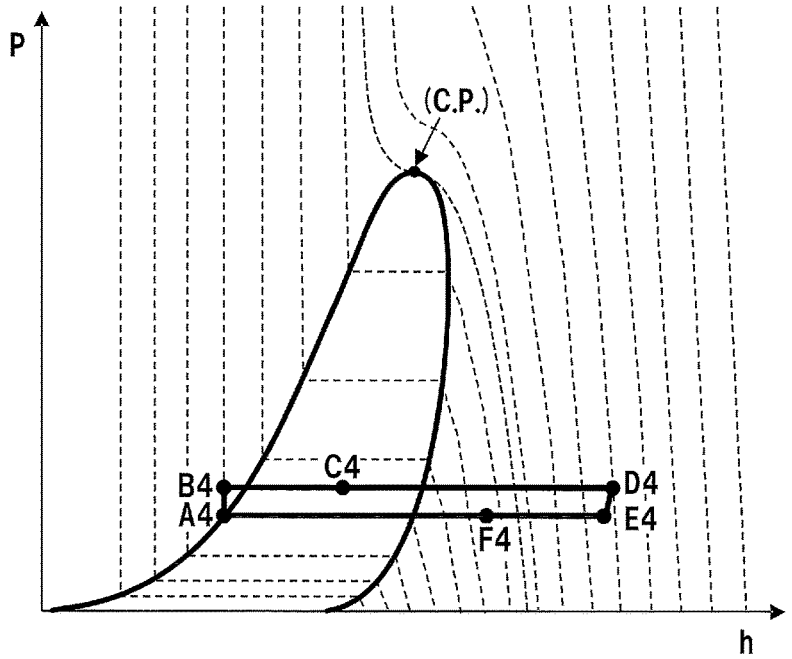
FIG. 5 is a Mollier diagram for the period during which the start-up operation of a Rankine cycle apparatus is at a transient stage.

When the operation of the expander 11 is thus started, the Rankine cycle apparatus 1A behaves in a manner as shown in FIG. 5. In FIG. 5, the positions at which the working fluid has states indicated by dots A4, B4, C4, D4, E4, and F4 are respectively the same as the positions at which the working fluid has the states indicated by the dots A1, B1, C1, D1, E1, and F1 of FIG. 2. In this case, some of the working fluid flowing out of the evaporator 15 is supplied to the expander 11 of the main circuit 10, while the rest of the working fluid is supplied to the bypass flow path 20. The working fluid in the expander 11 is adiabatically expanded, and the working fluid in the bypass flow path 20 is decompressed by the expansion valve 3B. Therefore, the working fluid changes from the state indicated by the dot D4 to the state indicated by the dot E4 between the outlet of the evaporator 15 and the inlet of the first heat exchange portion 12A. At this transient stage of the start-up operation, the liquid supply amount of the pump 14 is adjusted. In addition, the controller 5 changes the opening degree of the expansion valve 3B to a minimum level so that the flow rate of the working fluid in the bypass flow path 20 is at a minimum or zero. Thus, the number of revolutions of the expander 11 increases gradually. Thereafter, the difference between high and low pressures in the cycle is gradually increased by controlling the number of revolutions of the expander 11, and the operation of the Rankine cycle apparatus 1A shifts from the start-up operation to the normal operation.

Next, the stop operation of the Rankine cycle apparatus 1A will be described. In the stop operation, the Rankine cycle apparatus 1A is operated so that the behavior of the Rankine cycle apparatus 1A changes in the reverse order to that in the start-up operation. That is, the Rankine cycle apparatus 1A is operated so that the behavior of the Rankine cycle apparatus 1A makes transitions sequentially from the state shown in FIG. 2, to the state shown in FIG. 5, to the state shown in FIG. 4, and then to the state shown in FIG. 3. Specifically, at the early stage of the stop operation, the opening degree of the expansion valve 3B is increased, and the liquid supply amount of the pump 14 is adjusted. Thus, the number of revolutions of the expander 11 decreases gradually. As a result, the Rankine cycle apparatus 1A starts to behave in the state shown in FIG. 5. Next, the first on-off valve 3A is closed, and the expander 11 is stopped. The working fluid in the bypass flow path 20 is decompressed by the expansion valve 3B; therefore, the Rankine cycle apparatus 1A starts to behave in a manner as shown in FIG. 4. That is, the working fluid changes from the state indicated by the dot D3 to the state indicated by the dot E3 between the outlet of the evaporator 15 and the inlet of the first heat exchange portion 12A.

Next, the operation of the boiler 2 is stopped. Meanwhile, the pump 14 continues to be operated in order to cool the evaporator 15. Although the working fluid in the evaporator 15 is heated by the residual heat of the boiler 2, the amount of heating for the working fluid in the evaporator 15 decreases. Accordingly, the behavior of the Rankine cycle apparatus 1A changes from the state shown in FIG. 4 to the state shown in FIG. 3. That is, the working fluid at the outlet of the evaporator 15 changes to the wet vapor state as indicated by the dot D2 of FIG. 3.

When the temperature of the evaporator 15 is sufficiently lowered, the operation of the pump 14 is stopped. This is the end of the stop operation of the Rankine cycle apparatus 1A.

The adjustment of the flow rate of the working fluid in the bypass flow path 20 may be made during a period other than the start-up operation and the stop operation of the Rankine cycle apparatus 1A. For example, when the amount of heating for the working fluid in the evaporator 15 is reduced for some cause, there is a possibility that the working fluid at the outlet of the evaporator 15 changes from a superheated vapor state to a wet vapor state. In the course of this process, the working fluid at the inlet of the first heat exchange portion 12A changes from a superheated vapor state to a wet vapor state, and the amount of heat exchange between the first heat exchange portion 12A and the second heat exchange portion 12B decreases. Along with this, the difference between the two temperatures detected by the pair of temperature sensors 7A decreases. In such a situation, when the difference between the two temperatures detected by the pair of temperature sensors 7A becomes equal to or smaller than the second threshold, the controller 5 may control the flow rate-adjusting mechanism 3 so that the flow rate of the working fluid in the bypass flow path 20 is increased. Specifically, the controller 5 controls the flow rate-adjusting mechanism 3 so that the on-off valve 3A is closed and the expansion valve 3B is opened. This can prevent the working fluid in a liquid state from being supplied to the expander 11.

In the above case, in the course of the process in which the amount of heating for the working fluid in the evaporator 15 increases again from a reduced level, the working fluid at the outlet of the evaporator 15 changes from a wet vapor state to a superheated vapor state. In the course of this process, the working fluid at the inlet of the first heat exchange portion 12A changes from a wet vapor state to a superheated vapor state, and the amount of heat exchange between the first heat exchange portion 12A and the second heat exchange portion 12B increases. In such a situation, when the difference between the two temperatures detected by the pair of temperature sensors 7A exceeds the first threshold, the controller 5 may control the flow rate-adjusting mechanism 3 so that the flow rate of the working fluid in the bypass flow path 20 is reduced. Specifically, the controller 5 controls the flow rate-adjusting mechanism 3 so that the on-off valve 3A is opened and the expansion valve 3B is closed. This can ensure that the working fluid in a superheated vapor state is supplied to the expander 11. Furthermore, according to the present embodiment, a pressure sensor is not required for control of the flow rate in the bypass flow path 20.

Figure 6:
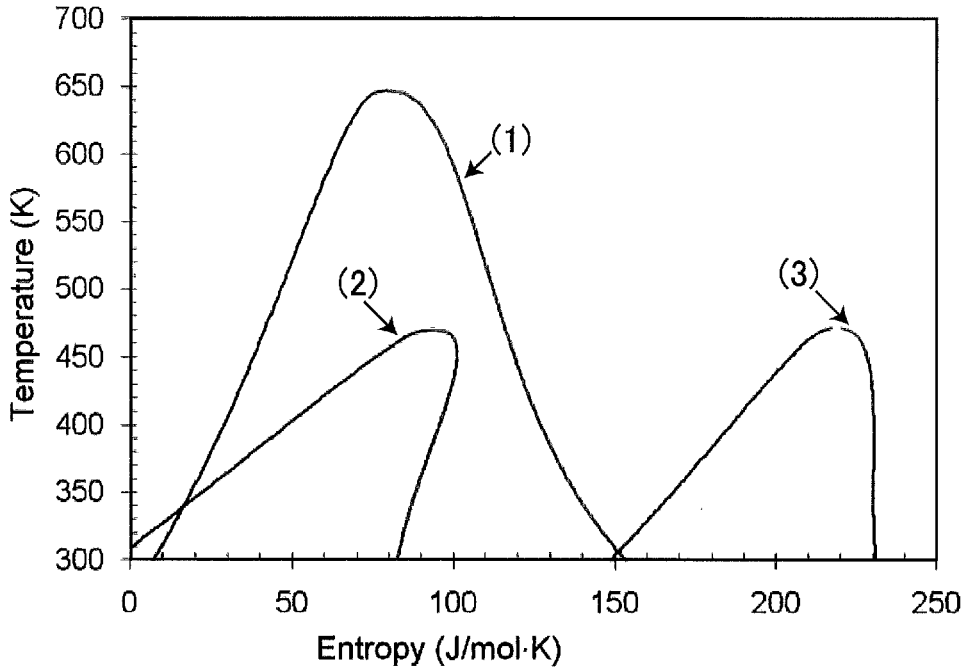
FIG. 6 is a T-s diagram for illustrating a desirable working fluid.

In the present embodiment, the working fluid is not particularly limited. The working fluid is, for example, water, an alcohol, a ketone, a hydrocarbon, or a fluorocarbon. As shown in FIG. 6, the working fluid is classified into three types depending on the value of ds/dT in a saturated vapor line on a T-s diagram. The first type of the working fluid is a fluid for which the value of ds/dT in a saturated vapor line on a T-s diagram is a negative value as shown in (1) of FIG. 6. The second type of the working fluid is a fluid for which the value of ds/dT in a saturated vapor line on a T-s diagram is a positive value as shown in (2) of FIG. 6. The third type of the working fluid is a fluid for which the value of ds/dT in a saturated vapor line on a T-s diagram is substantially zero as shown in (3) of FIG. 6. In the present description, "value of ds/dT is substantially zero" means that the value of ds/dT is equal to or smaller than $8\times10^{-4}$ kJ/(kg·K$^2$) at a range of pressures at which the Rankine cycle apparatus 1A is operated. Taking into account the reliability of the expander 11, it is preferable that the working fluid be a fluid that is present in a superheated vapor state at the inlet of the expander 11 when the fluid is in a superheated vapor state at the outlet of the expander 11. From this viewpoint, it is preferable that the working fluid be a fluid for which the value of ds/dT in a saturated vapor line on a T-s diagram is a negative value or is substantially zero.

Examples of the fluid for which the value of ds/dT in a saturated vapor line on a T-s diagram is a negative value include R21, cyclopropane, ammonia, propyne, water, benzene, and toluene. Examples of the fluid for which the value of ds/dT in a saturated vapor line on a T-s diagram is substantially zero include R123, R124, R141b, R142b, R245fa, and R245ca.

The magnitudes of the above first threshold and second threshold for the difference between the two temperatures detected by the pair of temperature sensors 7A are not particularly limited. The first threshold and the second threshold may be equal values or may be different values. In order to prevent a situation where the working fluid to be adiabatically expanded in the expander 11 is a wet vapor, it is preferable that the working fluid be a superheated vapor at the inlet of the expander 11 and at the outlet of the expander 11. From this viewpoint, it is recommended that the first threshold or the second threshold be set, for example, so that either the working fluid at the inlet of the expander 11 or the working fluid at the outlet of the expander 11, which has a smaller degree of superheat than the other, has a degree of superheat of 5 to 10° C. or more.

Second Embodiment

Next, a Rankine cycle apparatus 1B according to a second embodiment of the present disclosure will be described with reference to FIG. 7. Unless otherwise described, the second embodiment is configured in the same manner as the first embodiment. The components of the second embodiment that are the same as or correspond to those of the first embodiment are denoted by the same reference characters as used in the first embodiment, and the detailed descriptions of such components are omitted in some cases. That is, the description given for the first embodiment can apply to the present embodiment, unless technically inconsistent. This also holds true for the embodiments and modifications described later.

Figure 7:
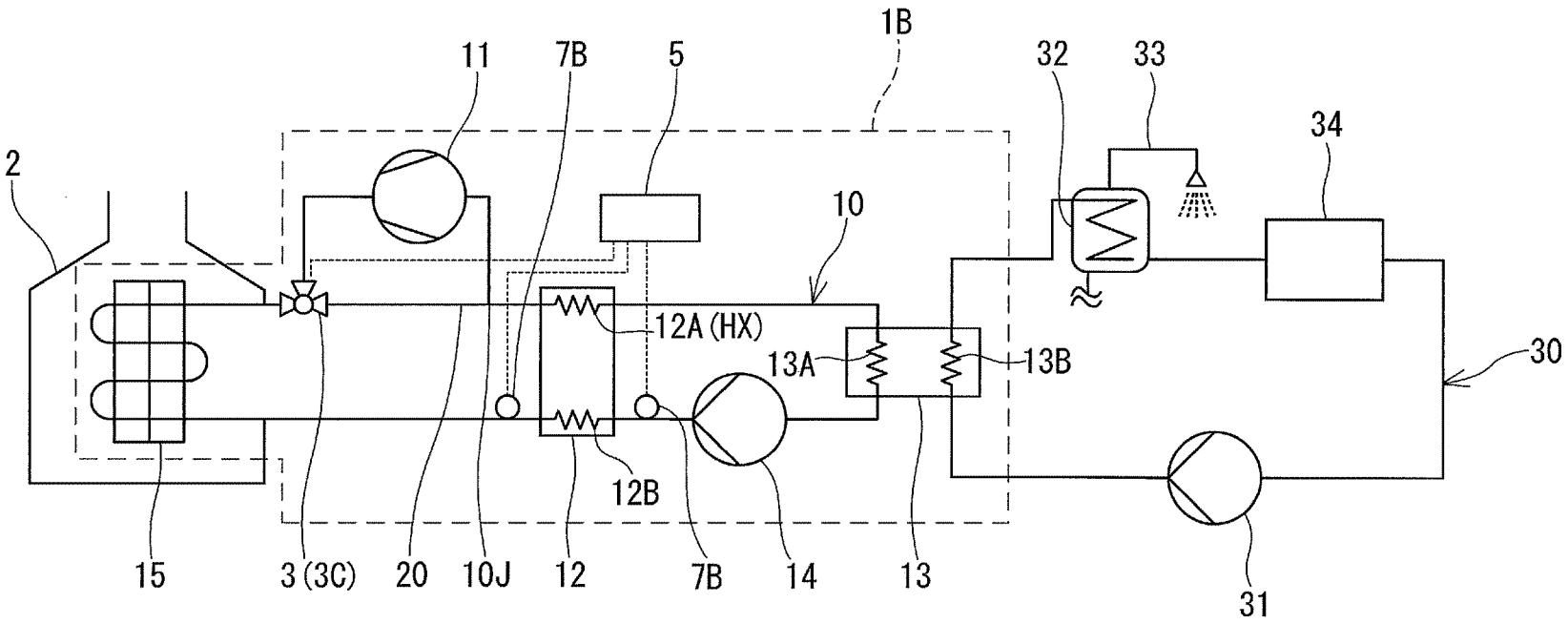
FIG. 7 is a configuration diagram of a Rankine cycle apparatus according to a second embodiment.

As shown in FIG. 7, the Rankine cycle apparatus 1B differs from the Rankine cycle apparatus 1A of the first embodiment in the configuration of the flow rate-adjusting mechanism 3 and the positions of a pair of temperature sensors 7B. The flow rate-adjusting mechanism 3 is a three-way valve 3C provided at a point of connection of the main circuit 10 to the upstream end of the bypass flow path 20. The three-way valve 3C is, for example, an electric operated three-way valve of the flow divider type. The three-way valve 3C divides the flow of the working fluid at the outlet of the evaporator 15 into the flow of the working fluid supplied to the expander 11 and the flow of the working fluid flowing in the bypass flow path 20. A directional control valve may be used as the three-way valve 3C.

The pair of temperature sensors 7B detects the temperature of the working fluid in the portion of the main circuit 10 between the outlet of the condenser 13 and the inlet of the second heat exchange portion 12B and the temperature of the working fluid in the portion of the main circuit 10 between the outlet of the second heat exchange portion 12B and the inlet of the evaporator 15. For this purpose, the pair of temperature sensors 7B are respectively provided in the portion of the main circuit 10 between the outlet of the condenser 13 and the inlet of the second heat exchange portion 12B and in the portion between the outlet of the second heat exchange portion 12B and the inlet of the evaporator 15. Specifically, one of the pair of temperature sensors 7B detects the temperature of the working fluid in the portion of the main circuit 10 between the outlet of the pump 14 and the inlet of the second heat exchange portion 12B. As mentioned herein, the portion of the main circuit 10 between the outlet of the pump 14 and the inlet of the second heat exchange portion 12B includes the inlet of the second heat exchange portion 12B. In the present embodiment, the one of the pair of temperature sensors 7B detects the temperature of the working fluid at the inlet of the second heat exchange portion 12B. It is sufficient for the one of the pair of temperature detection sensors 7B to be provided in the portion of the main circuit 10 between the outlet of the condenser 13 and the inlet of the second heat exchange portion 12B. The other of the pair of temperature sensors 7B may detect the temperature of the working fluid in the second heat exchange portion 12B. That is, the other of the pair of temperature sensors 7B may be provided at a position that is located in the flow path of the working fluid in the second heat exchange portion 12B and that is closer to the outlet of the second heat exchange portion 12B than a position located at an equal distance from the inlet and outlet of the second heat exchange portion 12B.

As shown in FIG. 3, when the working fluid at the inlet of the first heat exchange portion 12A is a wet vapor, the temperature of the working fluid in the portion of the main circuit 10 between the outlet of the condenser 13 and the inlet of the second heat exchange portion 12B (see the dot A2 and the dot B2) is approximately equal to the temperature of the working fluid in the portion of the main circuit 10 between the outlet of the second heat exchange portion 12B and the inlet of the evaporator 15 (see the dot C2). As shown in FIG. 4, when the working fluid at the inlet of the first heat exchange portion 12A is a superheated vapor, the temperature of the working fluid in the portion of the main circuit 10 between the outlet of the condenser 13 and the inlet of the second heat exchange portion 12B (see the dot A3 and the dot B3) is lower than the temperature of the working fluid in the portion of the main circuit 10 between the outlet of the second heat exchange portion 12B and the inlet of the evaporator 15 (see the dot C3). In the course of the process in which the working fluid at the inlet of the first heat exchange portion 12A changes from a wet vapor to a superheated vapor, the difference between the two temperatures detected by the pair of temperature sensors 7B increases. In the course of this process, when the difference between the two temperatures detected by the pair of temperature sensors 7B exceeds the first threshold, the controller 5 controls the flow rate-adjusting mechanism 3 (three-way valve 3C) so that the flow rate of the working fluid in the bypass flow path 20 is reduced.

In the course of the process in which the working fluid at the inlet of the first heat exchange portion 12A changes from a superheated vapor to a wet vapor, the difference between the two temperatures detected by the pair of temperature sensors decreases. In the course of this process, when the difference between the two temperatures detected by the pair of temperature sensors 7B becomes equal to or smaller than the second threshold, the controller 5 controls the flow rate-adjusting mechanism 3 (three-way valve 3C) so that the flow rate of the working fluid in the bypass flow path 20 is increased.

As described above, the supply of the working fluid in a liquid state to the expander 11 can be prevented by controlling the flow rate of the working fluid in the bypass flow path 20. In addition, the temperature of the working fluid in the portion of the main circuit 10 between the outlet of the condenser 13 and the inlet of the second heat exchange portion 12B and the temperature of the working fluid in the portion of the main circuit 10 between the outlet of the second heat exchange portion 12B and the inlet of the evaporator 15 are relatively low. That is, the pair of temperature sensors 7B are disposed at positions where the temperature is relatively low, which can ensure the long-term reliability of the temperature sensors 7B. In addition, since the difference between the ambient environmental temperature and the temperature of the working fluid at the position where each temperature sensor 7B is provided is small, the heat loss of the working fluid through a pipe can be reduced. Therefore, when the temperature sensor 7B is provided on the outer surface of a pipe, the temperature of the working fluid can be detected by the temperature sensor 7B with high accuracy.

The temperature of the working fluid is slightly increased due to the pressurization by the pump 14. In the present embodiment, as shown in FIG. 7, one of the pair of temperature sensors 7B detects the temperature of the working fluid in the portion of the main circuit 10 between the outlet of the pump 14 and the inlet of the second heat exchange portion 12B. Therefore, the first threshold or the second threshold for the difference between the two temperatures detected by the pair of temperature sensors can be set without considering the influence exerted by the pump on the temperature of the working fluid.

Third Embodiment

Figure 8:
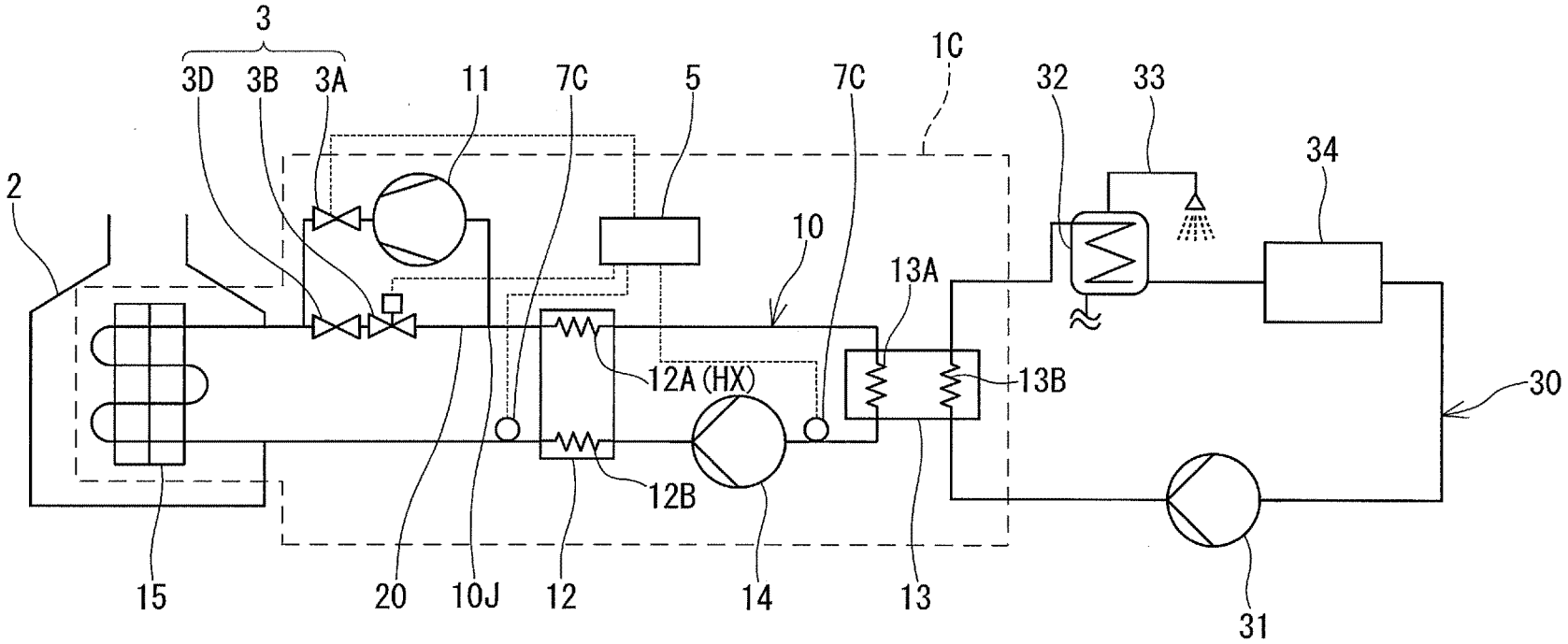
FIG. 8 is a configuration diagram of a Rankine cycle apparatus according to a third embodiment.

Next, a Rankine cycle apparatus 1C according to a third embodiment of the present disclosure will be described with reference to FIG. 8. The Rankine cycle apparatus 1C differs from the Rankine cycle apparatus 1A of the first embodiment in the configuration of the flow rate-adjusting mechanism 3 and the positions of a pair of temperature sensors 7C. As shown in FIG. 8, the flow rate-adjusting mechanism 3 further includes a second on-off valve 3D provided in the bypass flow path 20, in addition to the first on-off valve 3A and the expansion valve 3B. The second on-off valve is, for example, a solenoid on-off valve.

The pair of temperature sensors 7C detects the temperature of the working fluid in the portion of the main circuit 10 between the outlet of the condenser 13 and the inlet of the second heat exchange portion 12B and the temperature of the working fluid in the portion of the main circuit 10 between the outlet of the second heat exchange portion 12B and the inlet of the evaporator 15. Specifically, one of the pair of temperature sensors 7C detects the temperature of the working fluid in the portion of the main circuit 10 between the outlet of the condenser 13 and the inlet of the pump 14.

In the course of the process in which the working fluid at the inlet of the first heat exchange portion 12A changes from a wet vapor to a superheated vapor, the difference between the two temperatures detected by the pair of temperature sensors 7C increases. In the course of this process, when the difference between the two temperatures detected by the pair of temperature sensors 7C exceeds the first threshold, the controller 5 controls the flow rate-adjusting mechanism 3 so that the flow rate of the working fluid in the bypass flow path 20 is reduced. Specifically, the controller 5 performs control so that the first on-off valve 3A is opened, the second on-off valve 3D is closed, and the working fluid is supplied to the expander 11.

In the course of the process in which the working fluid at the inlet of the first heat exchange portion 12A changes from a superheated vapor to a wet vapor, the difference between the two temperatures detected by the pair of temperature sensors 7C decreases. In the course of this process, when the difference between the two temperatures detected by the pair of temperature sensors 7C becomes equal to or smaller than the second threshold, the controller 5 controls the flow rate-adjusting mechanism 3 so that the flow rate of the working fluid in the bypass flow path 20 is increased. Specifically, the controller 5 controls the flow rate-adjusting mechanism 3 so that the first on-off valve 3A is closed, the second on-off valve 3D is opened, and the expansion valve 3B is opened.

As described above, the supply of the working fluid in a liquid state to the expander 11 can be prevented by controlling the flow rate of the working fluid in the bypass flow path 20. In addition, the pair of temperature sensors 7C are disposed at positions where the temperature is relatively low, which can ensure the long-term reliability of the temperature sensors 7C.

<Modification>

The above embodiments can be modified in various respects. As shown in FIG. 3, when the working fluid at the inlet of the first heat exchange portion 12A is in the form of a wet vapor, the temperature of the working fluid at the inlet of the first heat exchange portion 12A (dot E2), the temperature of the working fluid in the portion of the main circuit 10 between the outlet of the first heat exchange portion 12A and the inlet of the condenser 13 (dot F2), the temperature of the working fluid in the portion of the main circuit 10 between the outlet of the condenser 13 and the inlet of the second heat exchange portion 12B (dot A2 and dot B2), and the temperature of the working fluid at the outlet of the second heat exchange portion 12B (dot C2) are approximately equal. As shown in FIG. 4, when the working fluid at the inlet of the first heat exchange portion 12A is a superheated vapor, any two temperatures among the above temperatures at four positions have different values, except for a combination of the temperature of the working fluid in the portion of the main circuit 10 between the outlet of the first heat exchange portion 12A and the inlet of the condenser 13 (dot F2) and the temperature of the working fluid in the portion of the main circuit 10 between the outlet of the condenser 13 and the inlet of the second heat exchange portion 12B (dot A2 and dot B2). Therefore, the pair of temperature sensors 7A may detect any two of the different temperatures, so that the flow rate of the working fluid in the bypass flow path 20 may be adjusted based on the difference between the two temperatures detected by the pair of temperature sensors 7A. Therefore, the pair of temperature sensors 7A may detect the temperature of the working fluid in the portion of the main circuit 10 between the junction point 10J and the inlet of the first heat exchange portion 12A and the temperature of the working fluid in the portion of the main circuit 10 between the outlet of the condenser 13 and the inlet of the second heat exchange portion 12B. Alternatively, the pair of temperature sensors 7A may detect the temperature of the working fluid in the portion of the main circuit 10 between the outlet of the first heat exchange portion 12A and the inlet of the condenser 13 and the temperature of the working fluid in the portion of the main circuit 10 between the outlet of the second heat exchange portion 12B and the inlet of the evaporator 15.

Fourth Embodiment

Figure 9:
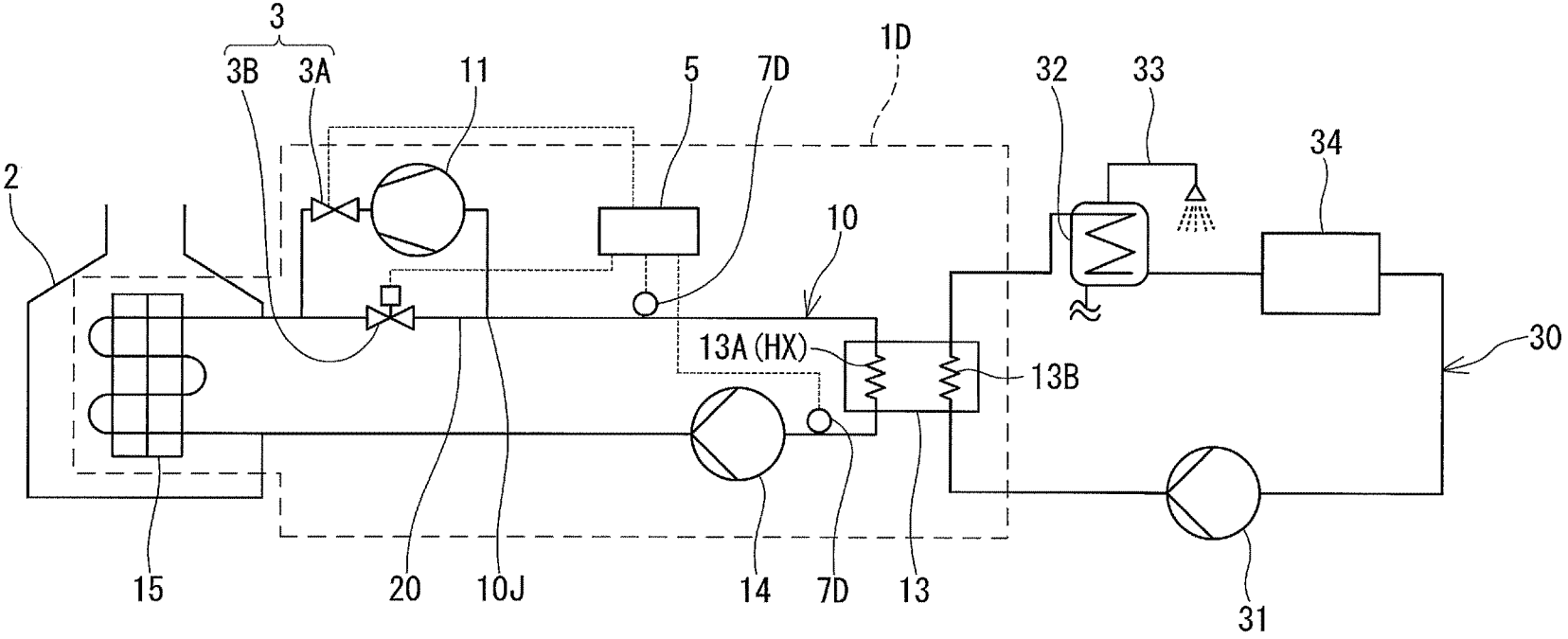
FIG. 9 is a configuration diagram of a Rankine cycle apparatus according to a fourth embodiment.

Next, a Rankine cycle apparatus 1D according to a fourth embodiment of the present disclosure will be described with reference to FIG. 9. The Rankine cycle apparatus 1D differs from the Rankine cycle apparatus 1A of the first embodiment in that the Rankine cycle apparatus 1D does not include the reheater 12 and in that the heat exchange portion HX is configured as a flow path (condensing portion) 13A of the working fluid in the condenser 13. A pair of temperature sensors 7D detects the temperature of the working fluid in the portion of the main circuit 10 between the junction point 10J and the inlet of the condenser 13 and the temperature of the working fluid in the portion of the main circuit 10 between the outlet of the condenser 13 and the inlet of the evaporator 15. Specifically, one of the pair of temperature sensors 7D detects the temperature of the working fluid in the portion of the main circuit 10 between the outlet of the condenser 13 and the inlet of the pump 14. In this case, the refrigerant at the inlet of the pump 14 is in a state of supercooled liquid; therefore, when the other temperature sensor 7D detects the temperature of the working fluid that is in a state of superheated gas, the difference between the two temperatures detected by the pair of temperature sensors 7D is large, and the state of the working fluid at the outlet of the expander 11 or the outlet of the bypass flow path 20 can easily be determined.

Figure 10:
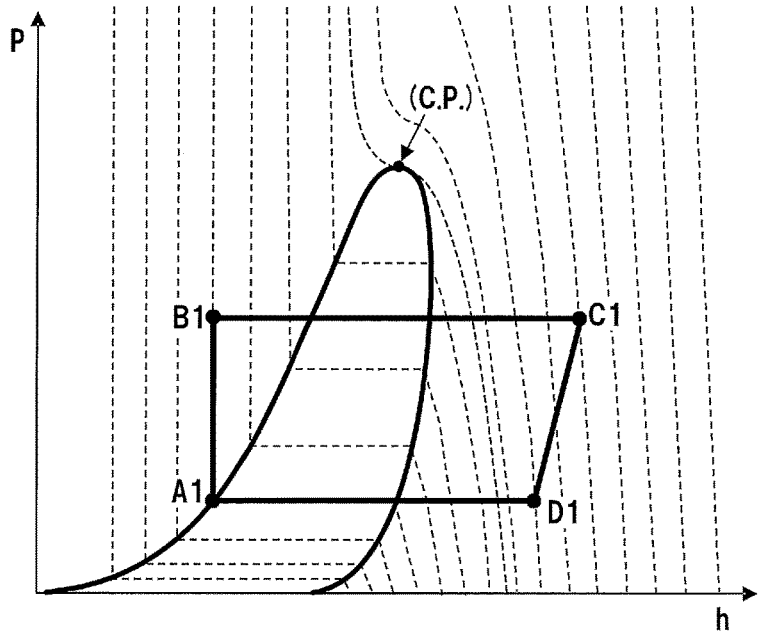
FIG. 10 is a Mollier diagram for the period during which a Rankine cycle apparatus is in normal operation.

The behavior of the Rankine cycle apparatus 1D in the normal operation will be described with reference to FIG. 10. A dot A1 in FIG. 10 indicates the state of the working fluid in the portion of the main circuit 10 between the outlet of the condenser 13 and the inlet of the pump 14. In this state, the working fluid is a saturated liquid or a supercooled liquid. The working fluid is pressurized by the pump 14. At this time, the temperature of the working fluid hardly changes; therefore, the working fluid in the portion of the main circuit 10 between the outlet of the pump 14 and the inlet of the evaporator 15 is a supercooled liquid as indicated by a dot B1.

The working fluid is heated in the evaporator 15 and changes to a superheated vapor. Therefore, the working fluid at the outlet of the evaporator 15 is a superheated vapor as indicated by a dot C1. The working fluid in the form of this superheated vapor is supplied to the expander 11, and the working fluid is adiabatically expanded by the expander 11. Therefore, the working fluid in the portion of the main circuit 10 between the junction point 10J and the inlet of the condenser 13 is a superheated vapor as indicated by a dot D1. The working fluid in the condenser 13 is cooled and condensed by cooling water in the cooling portion 13B. Therefore, the working fluid in the portion of the main circuit 10 between the outlet of the condenser 13 and the inlet of the pump 14 is a saturated liquid or a supercooled liquid as indicated by the dot A1. In the normal operation of the Rankine cycle apparatus 1D, the working fluid circulates in the main circuit 10 with the state changes as described above.

Figure 11:
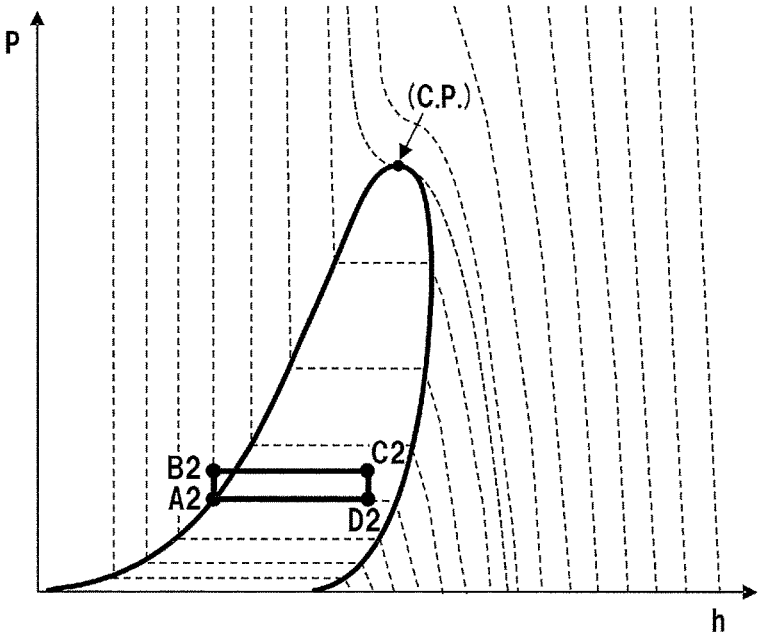
FIG. 11 is a Mollier diagram for the period during which the start-up operation of a Rankine cycle apparatus is at an early stage.

The adjustment of the flow rate of the working fluid in the bypass flow path 20 will be described using the start-up operation and stop operation of the Rankine cycle apparatus 1D as examples. At the early stage of the start-up operation, the liquid supply amount of the pump 14 is set at a maximum. In this case, the Rankine cycle apparatus 1D behaves in a manner as shown in FIG. 11. In FIG. 11, the positions at which the working fluid has states indicated by dots A2, B2, C2, and D2 are respectively the same as the positions at which the working fluid has the states indicated by the dots A1, B1, C1, and D1 of FIG. 10. As shown in FIG. 11, the state of the working fluid at the outlet of the evaporator 15 is the wet vapor state as indicated by the dot C2. Therefore, at the early stage of the start-up operation, the on-off valve 3A is closed, so that the supply of the working fluid in a liquid state to the expander 11 is prevented. In addition, the operation of the expander 11 is at a stop. After flowing out of the evaporator 15, the working fluid flows in the bypass flow path 20 at a maximum flow rate. The working fluid in the bypass flow path 20 is decompressed by the expansion valve 3B; therefore, the working fluid in the portion of the main circuit 10 between the junction point 10J and the inlet of the condenser 13 is a wet vapor as indicated by the dot D2.

When the working fluid in the portion of the main circuit 10 between the junction point 10J and the inlet of the condenser 13 is a wet vapor, the temperature of the working fluid hardly changes in the condenser 13. Therefore, the difference between the two temperatures detected by the pair of temperature sensors 7D could not exceed the first threshold. Accordingly, the controller 5 does not perform such control of the flow rate-adjusting mechanism 3 that the flow rate of the working fluid in the bypass flow path 20 is reduced.

Figure 12:
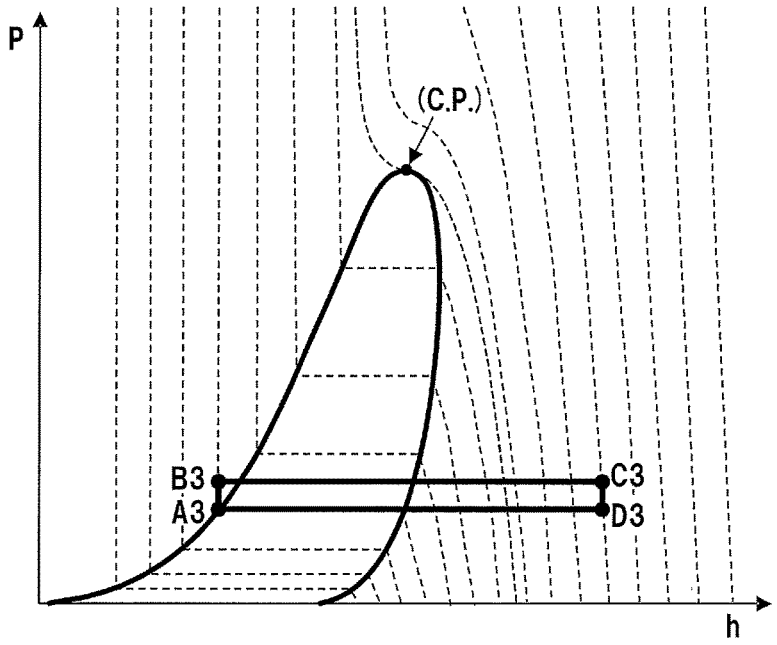
FIG. 12 is a Mollier diagram for the period during which the start-up operation of a Rankine cycle apparatus is at a transient stage.

At the transient stage of the start-up operation, the liquid supply amount of the pump 14 is decreased gradually. In this case, the behavior of the Rankine cycle apparatus 1D gradually changes from the state shown in FIG. 11 to the state shown in FIG. 12. In FIG. 12, the positions at which the working fluid has states indicated by dots A3, B3, C3, and D3 are respectively the same as the positions at which the working fluid has the states indicated by the dots A1, B1, C1, and D1 of FIG. 10.

As shown in FIG. 12, at the transient stage of the start-up operation, the working fluid at the outlet of the evaporator 15 changes to a superheated vapor, increases its degree of superheat, and enters the state indicated by the dot C3. In this case, the working fluid in the portion of the main circuit 10 between the junction point 10J and the inlet of the condenser 13 also increases its degree of superheat, and changes to a superheated vapor as indicated by the dot D3. Meanwhile, the working fluid in the portion of the main circuit 10 between the outlet of the condenser 13 and the inlet of the pump 14 is, as indicated by the dot A3, a saturated liquid or a supercooled liquid supercooled to a temperature slightly below the saturation temperature. The temperature of the working fluid is hardly changed by the pump 14; therefore, the working fluid in the portion of the main circuit 10 between the outlet of the pump 14 and the inlet of the evaporator 15 is a supercooled liquid as indicated by the dot B3. Accordingly, the temperature of the working fluid in the portion of the main circuit 10 between the junction point 10J and the inlet of the condenser 13 is higher than the temperature of the working fluid in the heat exchange portion HX or than the temperature of the working fluid in the portion of the main circuit 10 between the outlet of the condenser 13 and the inlet of the evaporator 15. Consequently, a difference occurs between the two temperatures detected by the pair of temperature sensors 7D, and the temperature difference gradually increases. In the course of this process, when the difference between the two temperatures detected by the pair of temperature sensors 7D exceeds the first threshold, the controller 5 controls the flow rate-adjusting mechanism 3 so that the flow rate of the working fluid in the bypass flow path 20 is reduced. Specifically, the first on-off valve 3A is opened, and the working fluid is supplied to the expander 11. In this case, the working fluid at the outlet of the evaporator 15 is a superheated vapor; therefore, the working fluid in a liquid state is not supplied to the expander 11. This prevents a situation where the reliability of the expander 11 is reduced by supply of the working fluid in a liquid state. As mentioned herein, the temperature of the working fluid in the heat exchange portion HX means, for example, a temperature of the working fluid at a position that is located in the flow path of the working fluid in the condenser 13 and that is closer to the outlet of the condenser 13 than a position located at an equal distance from the inlet and outlet of the condenser 13.

Figure 13:
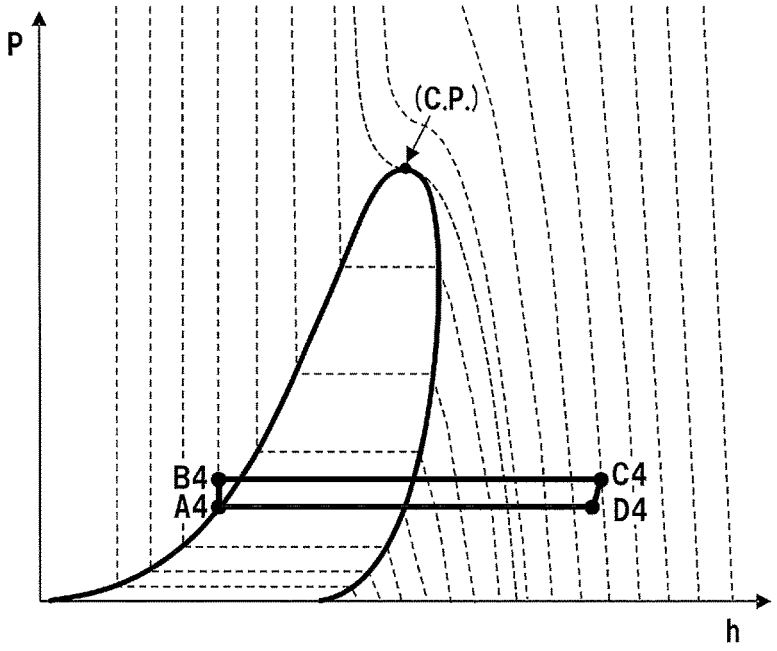
FIG. 13 is a Mollier diagram for the period during which the start-up operation of a Rankine cycle apparatus is at a transient stage.

When the operation of the expander 11 is subsequently started, the Rankine cycle apparatus 1D behaves in a manner as shown in FIG. 13. In FIG. 13, the positions at which the working fluid has states indicated by dots A4, B4, C4, and D4 are respectively the same as the positions at which the working fluid has the states indicated by the dots A1, B1, C1, and D1 of FIG. 10. In this case, some of the working fluid flowing out of the evaporator 15 is supplied to the expander 11 of the main circuit 10, while the rest of the working fluid is supplied to the bypass flow path 20. The working fluid in the expander 11 is adiabatically expanded, and the working fluid in the bypass flow path 20 is decompressed by the expansion valve 3B. Therefore, the working fluid changes from the state indicated by the dot C4 to the state indicated by the dot D4 between the outlet of the evaporator 15 and the inlet of the first heat exchange portion 12A. At this transient stage of the start-up operation, the liquid supply amount of the pump 14 is adjusted. In addition, the controller 5 changes the opening degree of the expansion valve 3B to a minimum level so that the flow rate of the working fluid in the bypass flow path 20 is at a minimum or zero. Thus, the number of revolutions of the expander 11 increases gradually. Thereafter, the difference between high and low pressures in the cycle is gradually increased by controlling the number of revolutions of the expander 11, and the operation of the Rankine cycle apparatus 1D shifts from the start-up operation to the normal operation.

Next, the stop operation of the Rankine cycle apparatus 1D will be described. In the stop operation, the Rankine cycle apparatus 1D is operated so that the behavior of the Rankine cycle apparatus 1D changes in the reverse order to that in the start-up operation. That is, the Rankine cycle apparatus 1D is operated so that the behavior of the Rankine cycle apparatus 1D makes transitions sequentially from the state shown in FIG. 10, to the state shown in FIG. 13, to the state shown in FIG. 12, and then to the state shown in FIG. 11. Specifically, at the early stage of the stop operation, the opening degree of the expansion valve 3B is increased, and the liquid supply amount of the pump 14 is adjusted. Thus, the number of revolutions of the expander 11 decreases gradually. As a result, the Rankine cycle apparatus 1D starts to behave in the state shown in FIG. 13. Next, the first on-off valve 3A is closed, and the expander 11 is stopped. The working fluid in the bypass flow path 20 is decompressed by the expansion valve 3B; therefore, the Rankine cycle apparatus 1D starts to behave in a manner as shown in FIG. 12.

Next, the operation of the boiler 2 is stopped. Meanwhile, the pump 14 continues to be operated in order to cool the evaporator 15. Although the working fluid in the evaporator 15 is heated by the residual heat of the boiler 2, the amount of heating for the working fluid in the evaporator 15 decreases. Accordingly, the behavior of the Rankine cycle apparatus 1D changes from the state shown in FIG. 12 to the state shown in FIG. 11. That is, the working fluid at the outlet of the evaporator 15 changes to the wet vapor state as indicated by the dot C2 of FIG. 11.

When the temperature of the evaporator 15 is sufficiently lowered, the operation of the pump 14 is stopped. This is the end of the stop operation of the Rankine cycle apparatus 1D.

The adjustment of the flow rate of the working fluid in the bypass flow path 20 may be made during a period other than the start-up operation and the stop operation of the Rankine cycle apparatus 1D. For example, when the amount of heating for the working fluid in the evaporator 15 is reduced for some cause, there is a possibility that the working fluid at the outlet of the evaporator 15 changes from a superheated vapor state to a wet vapor state. With this change, the difference between the two temperatures detected by the pair of temperature sensors 7D decreases. In such a situation, when the difference between the two temperatures detected by the pair of temperature sensors 7D becomes equal to or smaller than the second threshold, the controller 5 may control the flow rate-adjusting mechanism 3 so that the flow rate of the working fluid in the bypass flow path 20 is increased. Specifically, the controller 5 controls the flow rate-adjusting mechanism 3 so that the on-off valve 3A is closed and the expansion valve 3B is opened. This can prevent the working fluid in a liquid state from being supplied to the expander 11.

In the above case, in the course of the process in which the amount of heating for the working fluid in the evaporator 15 increases again from a reduced level, the working fluid at the outlet of the evaporator 15 changes from a wet vapor state to a superheated vapor state. In the course of this process, the working fluid at the inlet of the first heat exchange portion 12A changes from a wet vapor state to a superheated vapor state. In such a situation, when the difference between the two temperatures detected by the pair of temperature sensors 7D exceeds the first threshold, the controller 5 may control the flow rate-adjusting mechanism 3 so that the flow rate of the working fluid in the bypass flow path 20 is reduced. Specifically, the controller 5 controls the flow rate-adjusting mechanism 3 so that the on-off valve 3A is opened and the expansion valve 3B is closed. This can ensure that the working fluid in a superheated vapor state is supplied to the expander 11.

<Modifications>

Figure 14:
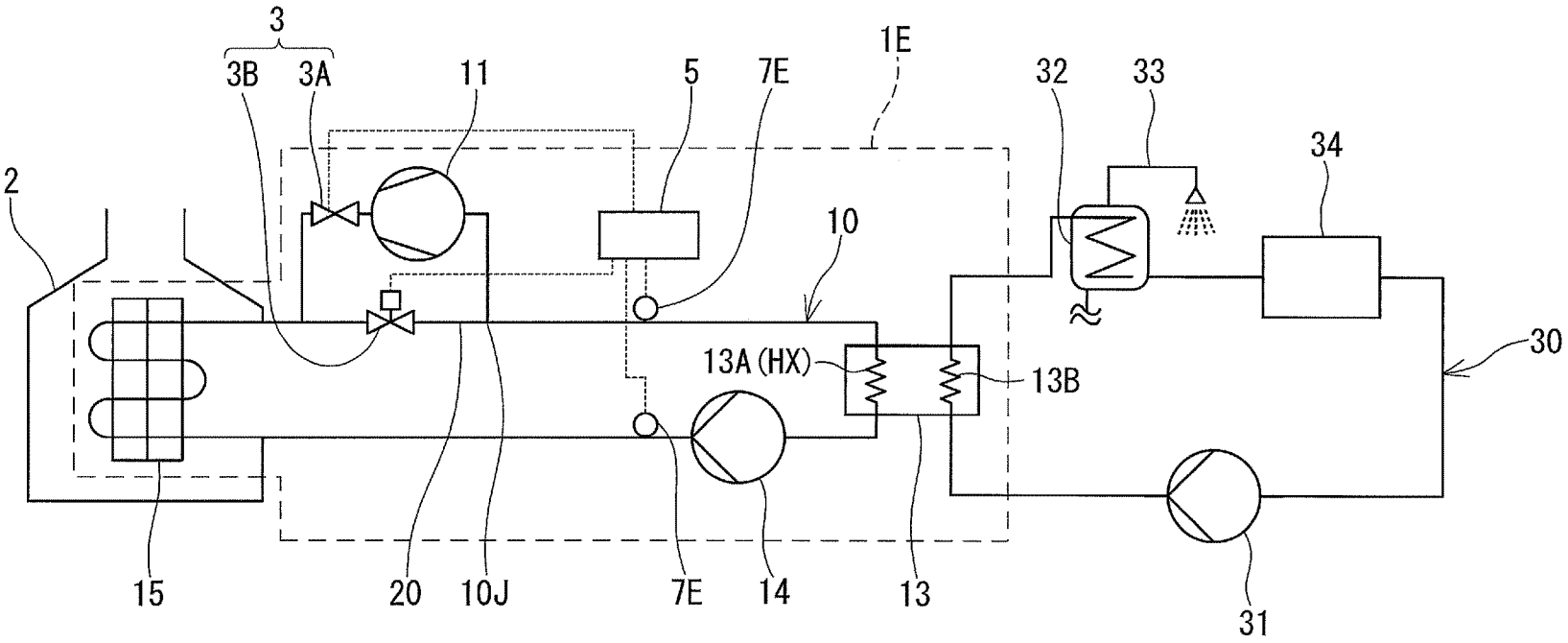
FIG. 14 is a configuration diagram of a Rankine cycle apparatus according to a modification.

Next, a Rankine cycle apparatus 1E according to a modification of the fourth embodiment will be described with reference to FIG. 14. The Rankine cycle apparatus 1E is configured in the same manner as the Rankine cycle apparatus 1D, except that one of a pair of temperature sensors 7E detects the temperature of the working fluid in the portion of the main circuit 10 between the outlet of the pump 14 and the inlet of the evaporator 15. That is, the pair of temperature sensors 7E detects the temperature of the working fluid in the portion of the main circuit 10 between the junction point 10J and the inlet of the condenser 13 and the temperature of the working fluid in the portion of the main circuit 10 between the outlet of the pump 14 and the inlet of the evaporator 15. In this case, the temperature sensor is placed on the side of the outlet of the pump 14; therefore, the length of the piping from the condenser 13 to the pump 14 can be shortened. Accordingly, heat input from the external environment to the working fluid on the side of the inlet of the pump 14 can be prevented, and cavitation due to pressure loss of the working fluid can be reduced.

In the course of the process in which the working fluid at the inlet of the condenser 13 changes from a wet vapor to a superheated vapor, the difference between the two temperatures detected by the pair of temperature sensors 7E increases. In the course of this process, when the difference between the two temperatures detected by the pair of temperature sensors 7E exceeds the first threshold, the controller 5 controls the flow rate-adjusting mechanism 3 so that the flow rate of the working fluid in the bypass flow path 20 is reduced. Specifically, the controller 5 controls the flow rate-adjusting mechanism 3 so that the on-off valve 3A is opened and the expansion valve 3B is closed.

In the course of the process in which the working fluid at the inlet of the condenser 13 changes from a superheated vapor to a wet vapor, the difference between the two temperatures detected by the pair of temperature sensors 7E decreases. In the course of this process, when the difference between the two temperatures detected by the pair of temperature sensors 7E becomes equal to or smaller than the second threshold, the controller 5 controls the flow rate-adjusting mechanism 3 so that the flow rate of the working fluid in the bypass flow path 20 is increased. Specifically, the controller 5 controls the flow rate-adjusting mechanism 3 so that the on-off valve 3A is closed and the expansion valve 3B is opened.

Figure 15:
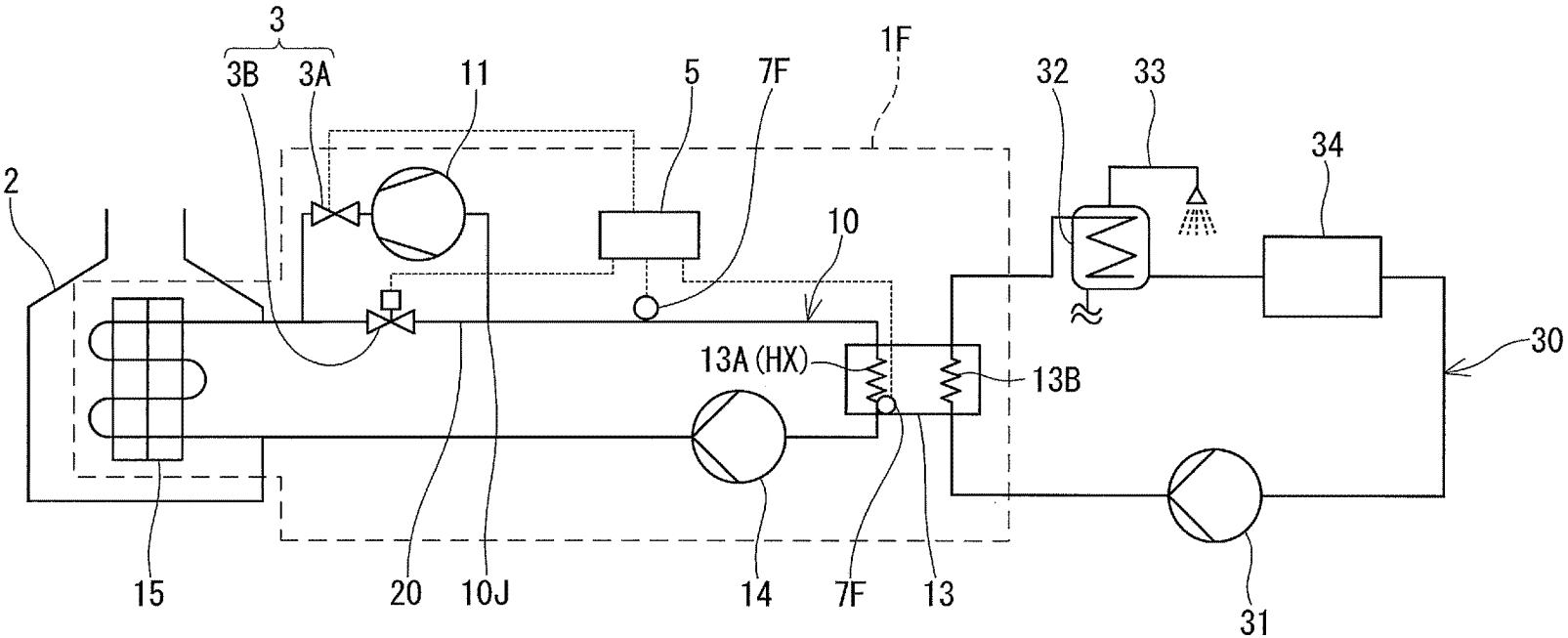
FIG. 15 is a configuration diagram of a Rankine cycle apparatus according to another modification.
Figure 16:
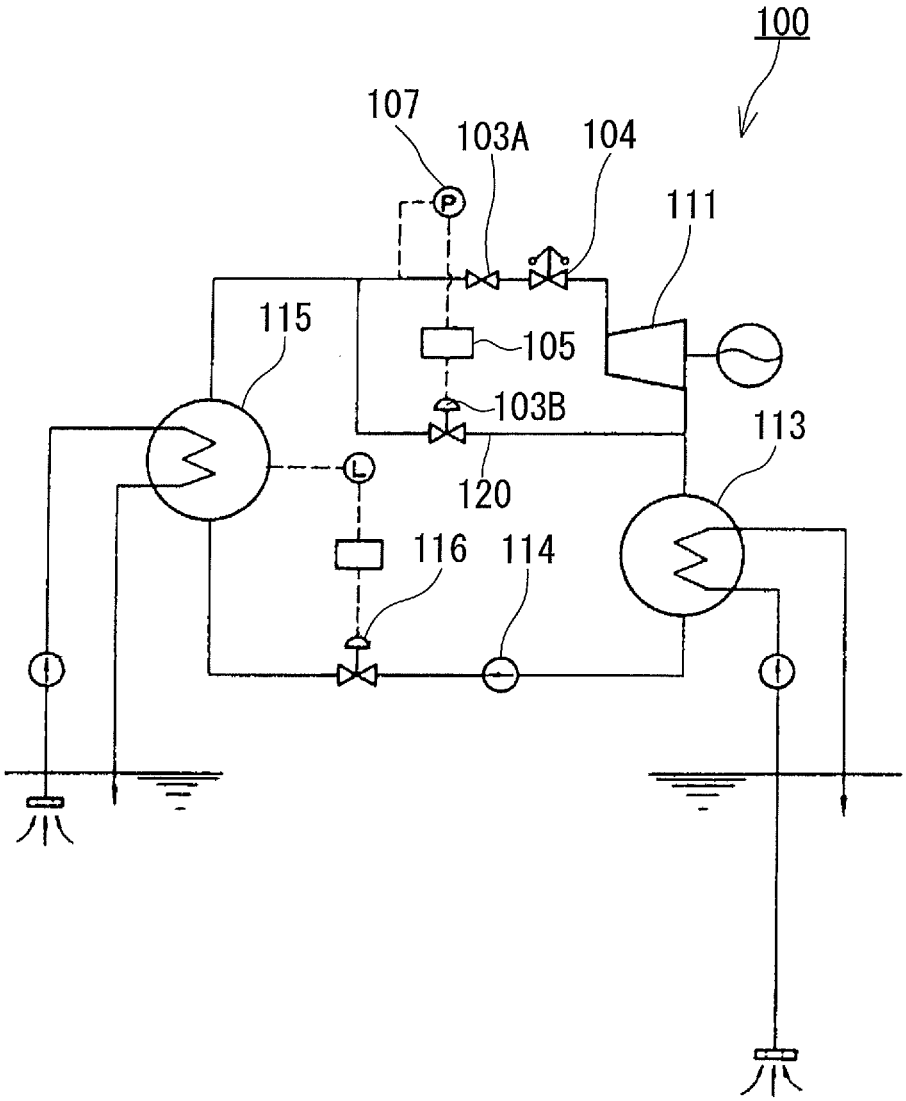
FIG. 16 is a configuration diagram of a conventional Rankine cycle apparatus.

Next, a Rankine cycle apparatus 1F according to another modification of the fourth embodiment will be described with reference to FIG. 15. The Rankine cycle apparatus 1F is configured in the same manner as the Rankine cycle apparatus 1D, except that the temperature of the working fluid in the condenser 13 is detected. That is, a pair of temperature sensors 7F detects the temperature of the working fluid in the portion of the main circuit 10 between the junction point 10J and the inlet of the condenser 13 and the temperature of the working fluid in the condenser 13. In this case, the temperature of the working fluid that is being condensed in the condenser 13 can be detected; that is, the condensation temperature can be detected. Therefore, when the value of the temperature of the working fluid in the portion of the main circuit 10 between the junction point 10J and the inlet of the condenser 13 is higher than the condensation temperature, the working fluid in the portion of the main circuit 10 between the junction point 10J and the inlet of the condenser 13 is in a state of superheated gas. Thus, the difference between the two temperatures can be detected by the pair of temperature sensors 7F accurately. As mentioned herein, the temperature of the working fluid in the condenser 13 means, for example, a temperature of the working fluid at a position that is located in the flow path of the working fluid in the condenser 13 and that is closer to the outlet of the condenser 13 than a position located at an equal distance from the inlet and outlet of the condenser 13.

In the course of the process in which the working fluid at the inlet of the condenser 13 changes from a wet vapor to a superheated vapor, the difference between the two temperatures detected by the pair of temperature sensors 7F increases. In the course of this process, when the difference between the two temperatures detected by the pair of temperature sensors 7F exceeds the first threshold, the controller 5 controls the flow rate-adjusting mechanism 3 so that the flow rate of the working fluid in the bypass flow path 20 is reduced. Specifically, the controller 5 controls the flow rate-adjusting mechanism 3 so that the on-off valve 3A is opened and the expansion valve 3B is closed.

In the course of the process in which the working fluid at the inlet of the condenser 13 changes from a superheated vapor to a wet vapor, the difference between the two temperatures detected by the pair of temperature sensors 7F decreases. In the course of this process, when the difference between the two temperatures detected by the pair of temperature sensors 7F becomes equal to or smaller than the second threshold, the controller 5 controls the flow rate-adjusting mechanism 3 so that the flow rate of the working fluid in the bypass flow path 20 is increased. Specifically, the controller 5 controls the flow rate-adjusting mechanism 3 so that the on-off valve 3A is closed and the expansion valve 3B is opened.

The invention claimed is:

1. A Rankine cycle apparatus comprising:

a main circuit formed by an expander, a condenser, a pump, and an evaporator that are circularly connected in this order;

a first heat exchanger located in the main circuit at a position between an outlet of the expander and an inlet of the pump;

a bypass flow path branching from the main circuit at a position between an outlet of the evaporator and an inlet of the expander and joining to the main circuit at a position between the outlet of the expander and an inlet of the heat exchanger;

a flow rate adjuster that adjusts a flow rate of a working fluid in the bypass flow path;

a pair of temperature sensors that detects temperatures of the working fluid at two positions spaced from each other in a flow direction of the working fluid in a portion of the main circuit between a junction point at which the bypass flow path joins to the main circuit and an inlet of the evaporator; and a controller that controls the flow rate adjuster so that the flow rate of the working fluid in the bypass flow path is reduced when the controller receives a first signal, the first signal representing that a difference between two temperatures detected by the pair of temperature sensors exceeds a first threshold.

2. The Rankine cycle apparatus according to claim 1, wherein the controller controls the flow rate adjuster so that the flow rate of the working fluid in the bypass flow path is increased when the controller receives a second signal, the second signal representing that a difference between two temperatures detected by the pair of temperature sensors becomes equal to or smaller than a second threshold.

3. The Rankine cycle apparatus according to claim 1, wherein the heat exchanger is configured as a flow path of the working fluid in the condenser, and the pair of temperature sensors detects: a temperature of the working fluid in a portion of the main circuit between the junction point and an inlet of the condenser; and one of:

a temperature of the working fluid in the condenser, or a temperature of the working fluid in a portion of the main circuit between an outlet of the condenser and the inlet of the evaporator.

4. The Rankine cycle apparatus according to claim 3, wherein the pair of temperature sensors detects the temperature of the working fluid in the portion of the main circuit between the junction point and the inlet of the condenser and a temperature of the working fluid in a portion of the main circuit between the outlet of the condenser and the inlet of the pump.

5. The Rankine cycle apparatus according to claim 3, wherein the pair of temperature sensors detects the temperature of the working fluid in the portion of the main circuit between the junction point and the inlet of the condenser and a temperature of the working fluid in a portion of the main circuit between an outlet of the pump and the inlet of the evaporator.

6. The Rankine cycle apparatus according to claim 3, wherein the pair of temperature sensors detects the temperature of the working fluid in the portion of the main circuit between the junction point and the inlet of the condenser and the temperature of the working fluid in the condenser.

7. The Rankine cycle apparatus according to claim 1, further comprising:

a second heat exchanger located in the main circuit at a position between an outlet of the pump and the inlet of the evaporator and adapted for heat exchange with the first heat exchanger, wherein the pair of temperature sensors detects a pair of temperatures selected from the group consisting of:

a temperature of the working fluid in a portion of the main circuit between the junction point and an inlet of the first heat exchanger and a temperature of the working fluid in the first heat exchanger;

the temperature of the working fluid in the portion of the main circuit between the junction point and the inlet of the first heat exchanger and a temperature of the working fluid in a portion of the main circuit between an outlet of the second heat exchanger and the inlet of the evaporator;

the temperature of the working fluid in the portion of the main circuit between the junction point and the inlet of the first heat exchanger and a temperature of the working fluid in a portion of the main circuit between an outlet of the condenser and an inlet of the second heat exchanger;

the temperature of the working fluid in the portion of the main circuit between the junction point and the inlet of the first heat exchanger and a temperature of the working fluid in the second heat exchanger;

the temperature of the working fluid in the portion of the main circuit between the junction point and the inlet of the first heat exchanger and a temperature of the working fluid in a portion of the main circuit between an outlet of the second heat exchanger and the inlet of the evaporator;

the temperature of the working fluid in the first heat exchanger and the temperature of the working fluid in the second heat exchanger;

the temperature of the working fluid in the first heat exchanger and the temperature of the working fluid in the portion of the main circuit between the outlet of the second heat exchanger and the inlet of the evaporator;

the temperature of the working fluid in a portion of the main circuit between an outlet of the second heat exchanger and the inlet of the evaporator and the temperature of the working fluid in the second heat exchanger;

the temperature of the working fluid in a portion of the main circuit between an outlet of the second heat exchanger and the inlet of the evaporator and the temperature of the working fluid in the portion of the main circuit between the outlet of the second heat exchanger and the inlet of the evaporator;

the temperature of the working fluid in the portion of the main circuit between the outlet of the condenser and the inlet of the second heat exchanger and the temperature of the working fluid in the second heat exchanger; and the temperature of the working fluid in the portion of the main circuit between the outlet of the condenser and the inlet of the second heat exchanger and the temperature of the working fluid in the portion of the main circuit between the outlet of the second heat exchanger and the inlet of the evaporator.

8. The Rankine cycle apparatus according to claim 7, wherein the pair of temperature sensors detects:

the temperature of the working fluid in the portion of the main circuit between the junction point and the inlet of the first heat exchanger; and one of:

the temperature of the working fluid in the portion of the main circuit between the outlet of the first heat exchanger and the inlet of the condenser, or the temperature of the working fluid in the first heat exchanger.

9. The Rankine cycle apparatus according to claim 7, wherein the pair of temperature sensors detects: the temperature of the working fluid in the portion of the main circuit between the outlet of the condenser and the inlet of the second heat exchanger; and one of:

the temperature of the working fluid in the portion of the main circuit between the outlet of the second heat exchanger and the inlet of the evaporator, or the temperature of the working fluid in the second heat exchanger.

10. The Rankine cycle apparatus according to claim 9, wherein one of the pair of temperature sensors detects a temperature of the working fluid in a portion of the main circuit between the outlet of the pump and the inlet of the second heat exchanger.

11. The Rankine cycle apparatus according to claim 1, wherein the working fluid is a fluid for which a value of ds/dT in a saturation vapor line on a T-s diagram is a negative value or is substantially zero.

12. The Rankine cycle apparatus according to claim 1, wherein the flow rate adjuster comprises a three-way valve provided at a point of connection of the main circuit to an upstream end of the bypass flow path.

13. The Rankine cycle apparatus according to claim 1, wherein the flow rate adjuster comprises: a first on-off valve provided in the main circuit at a position between a point of connection of the main circuit to an upstream end of the bypass flow path and the inlet of the expander; and an expansion valve provided in the bypass flow path.

14. The Rankine cycle apparatus according to claim 13, wherein the flow rate adjuster further comprises a second on-off valve provided in the bypass flow path.

* * * * *